US012089634B2

(12) United States Patent
Bellusci et al.

(10) Patent No.: US 12,089,634 B2
(45) Date of Patent: Sep. 17, 2024

(54) AEROSOL-GENERATING DEVICE COMPRISING A COVER ELEMENT MECHANISM

(71) Applicant: Philip Morris Products S.A., Neuchatel (CH)

(72) Inventors: Marco Bellusci, Arcore (IT); Miguel Borges, Neuchatel (CH); Jean-Luc Fringeli, Singapore (SG); Ilario Melzi, Cernusco sul Naviglio (IT)

(73) Assignee: Philip Morris Products S.A., Neuchatel (CH)

( * ) Notice: Subject to any disclaimer, the term of this patent is extended or adjusted under 35 U.S.C. 154(b) by 878 days.

(21) Appl. No.: 16/975,963

(22) PCT Filed: Mar. 8, 2019

(86) PCT No.: PCT/EP2019/055921
§ 371 (c)(1),
(2) Date: Aug. 26, 2020

(87) PCT Pub. No.: WO2019/170896
PCT Pub. Date: Sep. 12, 2019

(65) Prior Publication Data

US 2021/0007396 A1 Jan. 14, 2021

(30) Foreign Application Priority Data

Mar. 9, 2018 (EP) ..... 18161064

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
CPC ..... A24F 40/40; A24F 40/20
See application file for complete search history.

(56) References Cited

U.S. PATENT DOCUMENTS 3,750,435 A * 8/1973 Belkin ..... A24F 15/005 206/265
3,874,393 A * 4/1975 Strong ..... A24F 1/24 131/193

(Continued)

FOREIGN PATENT DOCUMENTS

CN 205695707 U 11/2016
CN 106535680 A 3/2017

(Continued)

OTHER PUBLICATIONS

Argentine Office Action issued Dec. 16, 2022 in Argentine Patent Application No. 2019 01 00575 (with English language translation), 8 pages.

(Continued)

*Primary Examiner* — Michael J Felton
*Assistant Examiner* — Courtney G Culbert
(74) *Attorney, Agent, or Firm* — Oblon, McClelland, Maier & Neustadt, L.L.P.

(57) ABSTRACT

An aerosol-generating device is provided, including: a first housing; a second housing configured to move relative to the first housing; a cavity configured to receive an aerosol-generating article; an aperture at least partially defined by the second housing and disposed at an end of the cavity for insertion of the article through the aperture; a cover element configured to move, with respect to the second housing, between a closed position in which the cover element at least partially covers the aperture and an open position in which the aperture is at least partially uncovered; a latching mechanism to retain the cover element in the open position and to release the cover element when the second housing is moved (Continued)

relative to the first housing; and a closing mechanism to move the cover element away from the open position and into the closed position when the latching mechanism releases the cover element.

17 Claims, 17 Drawing Sheets

(56) References Cited

U.S. PATENT DOCUMENTS

| | | | |
|---|---|---|---|
| 5,934,289 | A | 8/1999 | Watkins et al. |
| 9,826,780 | B2 | 11/2017 | Krietzman |
| 2016/0235122 | A1 | 8/2016 | Krietzman |
| 2016/0235123 | A1 | 8/2016 | Krietzman |
| 2016/0235124 | A1 | 8/2016 | Krietzman |
| 2017/0347708 | A1 | 12/2017 | Shin et al. |
| 2019/0029322 | A1 | 1/2019 | Krietzman |
| 2021/0137163 | A1* | 5/2021 | An ..... A24F 40/40 |

FOREIGN PATENT DOCUMENTS

| | | | |
|---|---|---|---|
| CN | 106572708 | A | 4/2017 |
| EP | 3 235 390 | A1 | 10/2017 |
| EP | 3 761 817 | B1 | 6/2022 |
| JP | 2002-514910 | A | 5/2002 |
| JP | 2017-538449 | A | 12/2017 |
| KR | 10-2016-0073265 | A | 6/2016 |
| RU | 2 531 890 | C2 | 10/2014 |
| RU | 2 614 376 | C2 | 3/2017 |
| RU | 2 627 005 | C2 | 8/2017 |
| WO | WO 98/17130 | A1 | 4/1998 |
| WO | WO 2015/165906 | A1 | 11/2015 |
| WO | WO 2017/194751 | A1 | 11/2017 |
| WO | WO 2019/164135 | A1 | 8/2019 |
| WO | WO 2019/170893 | A1 | 9/2019 |
| WO | WO 2019/170901 | A1 | 9/2019 |

OTHER PUBLICATIONS

Combined Russian Office Action and Search Report issued on Jul. 1, 2022 in Russian Patent Application No. 2020131524/03 (with English translation), 11 pages.

International Search Report issued May 20, 2019 in PCT/EP2019/055921 filed Mar. 8, 2019, 4 pages.

Written Opinion issued May 20, 2019 in PCT/EP2019/055921 filed Mar. 8, 2019, 5 pages.

Japanese Office Action issued Mar. 23, 2023 in Japanese Patent Application No. 2020-544660 (with English translation), 3 pages.

Combined Chinese Office Action and Search Report issued Aug. 26, 2023 in Chinese Patent Application No. 201980012908.5 (with English Translation of Category of Cited Documents), 6 pages.

Australian Examination Report No. 1 issued on Oct. 19, 2023 in Australian Patent Application No. 2019229674, 4 pages.

Korean Notice of Allowance mailed on Jun. 27, 2027, issued in Korean Patent Application No. 10-2020-7024732, with English Translation, total 5 pages (citing document 15, therein).

* cited by examiner

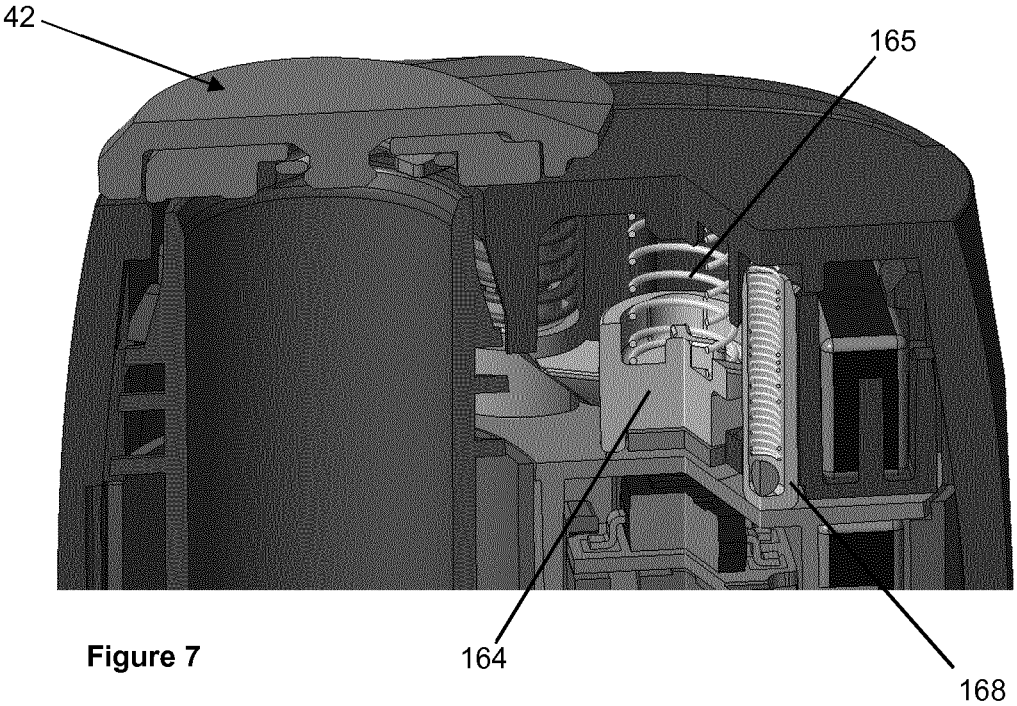
Figure 7
Figure 8
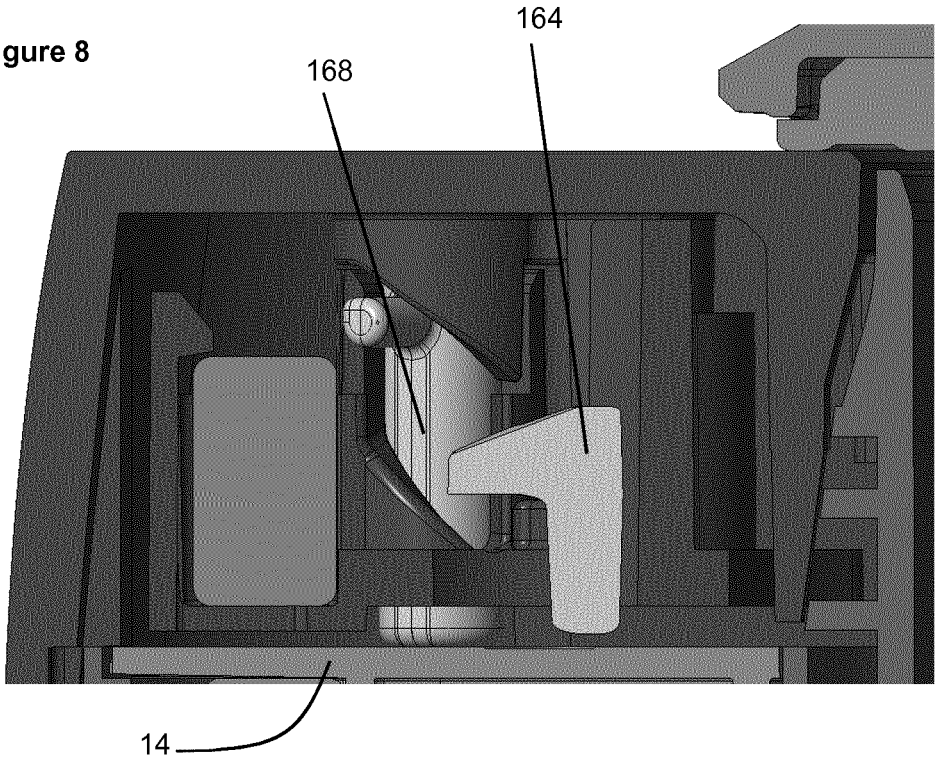

AEROSOL-GENERATING DEVICE COMPRISING A COVER ELEMENT MECHANISM

The present invention relates to an aerosol-generating device comprising a cover element, a latching mechanism and a closing mechanism. The present invention also relates to an aerosol-generating system comprising the aerosol-generating device and an aerosol-generating article.

One type of aerosol-generating system is an electrically operated smoking system. Known handheld electrically operated smoking systems typically comprise an aerosol-generating device comprising a battery, control electronics and an electric heater for heating an aerosol-generating article designed specifically for use with the aerosol-generating device. In some examples, the aerosol-generating article comprises an aerosol-forming substrate, such as a tobacco rod or a tobacco plug, and the heater contained within the aerosol-generating device is inserted into or located around the aerosol-forming substrate when the aerosol-generating article is inserted into the aerosol-generating device. In an alternative electrically operated smoking system, the aerosol-generating article may comprise a capsule containing an aerosol-forming substrate, such as loose tobacco.

In known electrically operated smoking systems the aerosol-generating article may be received within a cavity in the aerosol-generating device. Some aerosol-generating devices may comprise a sliding cover that a user may slide over an opening of the cavity when the aerosol-generating device is not being used. However, if the user forgets to close the sliding cover when the aerosol-generating device is not being used, dirt or foreign objects may contaminate the cavity and may damage the heater.

It would be desirable to provide an aerosol-generating device comprising a cover element that facilitates simple and reliable operation of the cover element.

According to a first aspect of the present invention there is provided an aerosol-generating device comprising a first housing, a second housing arranged for movement relative to the first housing, and a cavity for receiving an aerosol-generating article. The aerosol-generating device also comprises an aperture at least partially defined by the second housing, wherein the aperture is positioned at an end of the cavity for insertion of an aerosol-generating article into the cavity through the aperture. The aerosol-generating device also comprises a cover element arranged for movement with respect to the second housing between a closed position in which the cover element at least partially covers the aperture and an open position in which the aperture is at least partially uncovered. The aerosol-generating device also comprises a latching mechanism arranged to retain the cover element in the open position and arranged to release the cover element when the second housing is moved relative to the first housing. The aerosol-generating device also comprises a closing mechanism arranged to move the cover element away from the open position and into the closed position when the latching mechanism releases the cover element.

The latching mechanism is arranged to retain the cover element in the open position. Therefore, advantageously, the latching mechanism facilitates insertion of an aerosol-generating article into the cavity. For example, when a user is ready to use the aerosol-generating device, the user may move the cover element from the closed position and into the open position. When the cover element reaches the open position, the latching mechanism retains the cover element in the open position and eliminates the need for the user to hold the cover element in the open position while inserting an aerosol-generating article into the cavity.

The latching mechanism is arranged to release the cover element and the closing mechanism is arranged to move the cover element into the closed position when the second housing is moved relative to the first housing. Therefore, advantageously, the latching mechanism and the closing mechanism may provide automatic closing of the cover element when the second housing is moved relative to the first housing.

Preferably, the second housing is arranged for sliding movement relative to the first housing.

Preferably, the second housing at least partially defines the cavity. The cavity may comprise a first end defined by the aperture and a second end opposite the first end, wherein the second end is at least partially closed. Advantageously, when an aerosol-generating article is received within the cavity, moving the second housing away from the first housing may also move the aerosol-generating article away from the second housing. Advantageously, moving the aerosol-generating article away from the first housing may facilitate removal of the aerosol-generating article from the aerosol-generating device. Advantageously, facilitating removal of the aerosol-generating article with movement of the second housing away from the first housing may prompt a user to move the second housing relative to the first housing when removing the aerosol-generating article. Therefore, advantageously, the user is prompted to release the cover element from the latching mechanism so that the closing mechanism may move the cover element into the closed position when the aerosol-generating article is removed from the cavity.

The latching mechanism may be arranged to release the cover element when the second housing is moved away from the first housing. The latching mechanism may be arranged to release the cover element when the second housing is moved towards the first housing.

Preferably, the closing mechanism is arranged to move the cover element into the closed position when the second housing is moved towards the first housing.

Preferably, the cover element is arranged so that, when the cover element is in the closed position, the cover element covers at least about 50 percent of the aperture, more preferably at least about 60 percent of the aperture, more preferably at least about 70 percent of the aperture, more preferably at least about 80 percent of the aperture, more preferably at least about 90 percent of the aperture, more preferably at least about 95 percent of the aperture.

Preferably, the cover element is arranged so that the cover element entirely covers the aperture when the cover element is in the closed position. In other words, preferably the cover element is arranged so that the cover element covers 100 percent of the aperture when the cover element is in the closed position. Advantageously, arranging the cover element to entirely cover the aperture when the cover element is in the closed position may prevent the insertion of foreign objects into the cavity when the aerosol-generating device is not being used.

Preferably, the cover element is arranged so that the cover element covers less than about 5 percent of the aperture when the cover element is on the open position.

Preferably, the cover element is arranged so that the aperture is entirely uncovered when the cover element is in the open position. In other words, preferably the cover element is arranged so that the cover element covers none of the aperture when the cover element is in the open position.

Advantageously, arranging the cover element so that the aperture is entirely uncovered when the cover element is in the open position facilitates insertion of an aerosol-generating article into the cavity.

The cover element may be rotatable with respect to the second housing between the closed position and the open position. Advantageously, a rotatable cover element may be easier for a user to operate than a sliding cover element. For example, when a user is holding the aerosol-generating device with a hand, a rotational movement of the thumb of the same hand may be a more natural movement than a sliding motion. Therefore, advantageously, a rotatable cover element facilitates holding the aerosol-generating device and operating the cover element with a single hand. Advantageously, holding the aerosol-generating device and operating the cover element with a single hand facilitates insertion of an aerosol-generating article into the cavity. For example, a user may hold the aerosol-generating device in one hand and operate the cover element with the same hand, and at the same time use the remaining hand to hold an aerosol-generating article and insert the aerosol-generating article into the cavity. Known devices require a user to use both hands to hold the aerosol-generating device and operate a cover element before the user can pick up and insert an article into the device.

Preferably, the cover element comprises a cover portion and a shaft portion extending from the cover portion, wherein the cover portion is arranged to at least partially cover the aperture when the cover element is in the closed position, and wherein the shaft portion is received within the second housing. Advantageously, the shaft portion may facilitate rotation of the cover element between the closed position and the open position.

The cover portion and the shaft portion may be formed separately and attached to each other. For example, the cover portion and the shaft portion may be attached to each other using at least one of an adhesive, an interference fit, and a weld.

The cover portion and the shaft portion may be integrally formed. For example, the cover portion and the shaft portion may be formed as a single piece using a molding process.

The cover portion may be substantially planar. The cover portion may be disc-shaped.

Preferably, the shaft portion extends orthogonally with respect to the cover portion.

The cover element may be manually moveable from the closed position to the open position.

The latching mechanism may comprise a cam connected to the shaft portion of the cover element, the cam defining a cam surface, and a cam follower positioned within the second housing and engaged with the cam surface. The cam surface defines a detent in which the cam follower is received when the cover element is in the open position. Advantageously, when the cam follower is received within the detent, relative movement between the cam follower and the cam surface is prevented. Therefore, when the cam follower is received within the detent, the shaft portion is unable to rotate and the cover element is retained within the open position.

The cam and the shaft portion may be formed separately and attached to each other. For example, the cam and the shaft portion may be attached to each other using at least one of an adhesive, an interference fit, and a weld.

The cam and the shaft portion may be integrally formed. For example, the cam and the shaft portion may be formed as a single piece using a molding process.

The latching mechanism may comprise a cam follower biasing element arranged to bias the cam follower against the cam surface. Advantageously, the cam follower biasing element may facilitate movement of the cam follower into the detent when the cover element is moved into the open position. The cam follower biasing element may comprise a compression spring.

The latching mechanism may comprise a release pin positioned within the second housing and arranged for movement with respect to the second housing, wherein the first housing is arranged to engage the release pin when the second housing is moved relative to the first housing to bias the release pin against the cam follower to disengage the cam follower from the detent. Preferably, the release pin is moveable between a first position when the second housing is moved away from the first housing and a second position when the second housing is moved towards the first housing, wherein the latching mechanism further comprises a release pin biasing element arranged to bias the release pin towards the first position.

Preferably, when the second housing is moved towards the first housing, the first housing pushes against the first end of the release pin to overcome the biasing force of the release pin biasing element to move the release pin towards the second position. Preferably, when the release pin is in the second position, the release pin is engaged with the cam follower to disengage the cam follower from the detent.

The release pin biasing element may comprise a compression spring.

The closing mechanism may comprise a cover biasing element arranged to bias the cover element towards the closed position. The cover biasing element may comprise a torsion spring.

In embodiments in which the cover element comprises a shaft portion, the cover biasing element may be engaged with the shaft portion.

In embodiments in which the latching mechanism comprises a cam, the cover biasing element may be engaged with the cam.

The latching mechanism may comprise a first gear connected to the shaft portion of the cover element and a geared cam follower positioned within the second housing. A surface of the geared cam follower defines a second gear engaged with the first gear. The latching mechanism also comprises a first cam surface fixed with respect to the second housing, wherein the geared cam follower is engaged with the first cam surface. The first cam surface defines a detent in which the geared cam follower is received when the cover element is in the open position. Advantageously, when the geared cam follower is received within the detent, relative movement between the cam follower and the first cam surface is prevented. Therefore, when the cam follower is received within the detent, the shaft portion is unable to rotate and the cover element is retained within the open position.

The first gear and the shaft portion may be formed separately and attached to each other. For example, the first gear and the shaft portion may be attached to each other using at least one of an adhesive, an interference fit, and a weld.

The first gear and the shaft portion may be integrally formed. For example, the first gear and the shaft portion may be formed as a single piece using a molding process.

The first cam surface may be defined by the second housing.

The latching mechanism may comprise a chassis defining the first cam surface, wherein the chassis is fixed relative to the second housing.

The latching mechanism may comprise a cam follower biasing element arranged to bias the geared cam follower against the first cam surface. Advantageously, the cam follower biasing element may facilitate movement of the geared cam follower into the detent when the cover element is moved into the open position. The cam follower biasing element may comprise a compression spring.

The latching mechanism may comprise a release element positioned within the second housing and arranged for movement with respect to the second housing, wherein the first housing is arranged to engage the release pin when the second housing is moved relative to the first housing to bias the release element against the geared cam follower to disengage the geared cam follower from the detent.

Preferably, the release element is moveable between a first position when the second housing is moved away from the first housing and a second position when the second housing is moved towards the first housing, wherein the latching mechanism further comprises a release element biasing element arranged to bias the release element towards the first position.

Preferably, when the second housing is moved towards the first housing, the first housing pushes against the first end of the release element to overcome the biasing force of the release element biasing element to move the release element towards the second position. Preferably, when the release element is in the second position, the release pin is engaged with the geared cam follower to disengage the geared cam follower from the detent.

The release element biasing element may comprise a compression spring.

The closing mechanism may comprise a second cam surface fixed with respect to the second housing, wherein the release element is arranged to engage the second cam surface to rotate the release element from the second position to a third position. The release element is arranged to engage the geared cam follower so that, when the release element rotates from the second position to the third position, the release element rotates the geared cam follower to move the cover element from the open position to the closed position.

The second cam surface may be defined by the second housing.

The latching mechanism may comprise a chassis defining the second cam surface, wherein the chassis is fixed relative to the second housing.

The second housing may comprise an end wall, wherein the aperture extends through a first portion of the end wall. Preferably, the cover element is arranged to overlie a second portion of the end wall when the cover portion is in the open position. Advantageously, arranging the cover element to overlie a second portion of the end wall when the cover portion is in the open position may reduce the risk of damage to the cover element when the aerosol-generating device is being used with the cover element in the open position.

In embodiments in which the cover element comprises a shaft portion, preferably the shaft portion extends through an opening in the housing end wall. Preferably, the opening is positioned on a central portion of the end wall, wherein the central portion is positioned between the first portion of the end wall and the second portion of the end wall.

Preferably, the aerosol-generating device comprises a heater arranged to heat an aerosol-generating article when the aerosol-generating article is received within the cavity.

Preferably, the heater is connected to the first housing.

The heater may comprise an electrical heater.

The electrical heater may be positioned outside the cavity.

The electrical heater may be positioned within the cavity.

The electrical heater may be arranged to extend around and outer surface of an aerosol-generating article received within the cavity.

The electrical heater may be coil-shaped. The electrical heater may be configured to heat a fluid transport structure. The aerosol-generating device may comprise a fluid transport structure, wherein the electrical heater is arranged to heat the fluid transport structure. The fluid transport structure may comprise a wick. The electrical heater may be coil-shaped, wherein the electrical heater is coiled around the fluid transport structure.

The electrical heater may extend into the cavity. The electrical heater may be arranged to be received within an aerosol-generating article when the aerosol-generating article is inserted into the cavity. The electrical heater may be an elongate electrical heater. The electrical heater may be blade-shaped. The electrical heater may be pin-shaped. The electrical heater may be cone-shaped.

In embodiments in which the electrical heater is connected to the first housing and the cavity is at least partially defined by the second housing, preferably the second housing defines a heater opening through which the electrical heater may extend into the cavity.

The electrical heater may comprise an inductive heating element. During use, the inductive heating element inductively heats a susceptor material to heat an aerosol-generating article received within the cavity. The susceptor material may form part of the aerosol-generating device. The susceptor material may form part of the aerosol-generating article.

The electrical heater may comprise a resistive heating element. During use, an electrical current is supplied to the resistive heating element to generate heat by resistive heating.

Suitable materials for forming the resistive heating element include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and superalloys based on nickel, iron, cobalt, stainless steel, Timetal® and iron-manganese-aluminium based alloys.

In some embodiments, the resistive heating element comprises one or more stamped portions of electrically resistive material, such as stainless steel. Alternatively, the resistive heating element may comprise a heating wire or filament, for example a Ni—Cr (Nickel-Chromium), platinum, tungsten or alloy wire.

The electrical heater may comprise an electrically insulating substrate, wherein the resistive heating element is provided on the electrically insulating substrate. The electrically insulating substrate may be a ceramic material such as Zirconia or Alumina. Preferably, the electrically insulating substrate has a thermal conductivity of less than or equal to about 2 Watts per metre Kelvin.

Preferably, the aerosol-generating device comprises a power supply and a controller arranged to supply power from the power supply to the electrical heater during use of the aerosol-generating device. Preferably, the power supply and the controller are positioned within the first housing.

Preferably, the controller is arranged to supply power from the power supply to the electrical heater according to a predetermined heating cycle when the aerosol-generating device is used to heat an aerosol-generating article received within the cavity.

In embodiments in which the electrical heater comprises a resistive heating element, the controller may be arranged to supply power from the power supply to the resistive heating element according to a predetermined pyrolysis cycle to clean the electrical heater when there is not an aerosol-generating article received within the cavity. The pyrolysis cycle may clean the electrical heater by pyrolysis of residue remaining on the electrical heater after use of the aerosol-generating device to heat one or more aerosol-generating articles. Typically, the maximum temperature to which the electrical heater is heated during a pyrolysis cycle is higher than the maximum temperature to which the electrical heater is heated during a heating cycle to heat an aerosol-generating article. Typically, the total duration of a pyrolysis cycle is shorter than the total duration of a heating cycle.

The second housing may be detachable from the first housing. Advantageously, detaching the second housing from the first housing may facilitate cleaning of the electrical heater.

The power supply may be a DC voltage source. In preferred embodiments, the power supply is a battery. For example, the power supply may be a nickel-metal hydride battery, a nickel cadmium battery, or a lithium based battery, for example a lithium-cobalt, a lithium-iron-phosphate or a lithium-polymer battery. The power supply may alternatively be another form of charge storage device such as a capacitor. The power supply may require recharging and may have a capacity that allows for the storage of enough energy for use of the aerosol-generating device with one or more aerosol-generating articles.

Preferably, the aerosol-generating device comprises at least one air inlet. Preferably, the at least one air inlet is in fluid communication with an upstream end of the cavity. In embodiments in which the aerosol-generating device comprises an elongate electrical heater, preferably the elongate electrical heater extends into the cavity from the upstream end of the cavity.

The at least one air inlet may be formed by a gap between the first housing and the second housing. In embodiments in which the second housing defines a heater opening through which an electrical heater extends into the cavity, preferably the heater opening is in fluid communication with the at least one air inlet.

The aerosol-generating device may comprise a sensor to detect air flow indicative of a user taking a puff. The air flow sensor may be an electro-mechanical device. The air flow sensor may be any of: a mechanical device, an optical device, an opto-mechanical device and a micro electro-mechanical systems (MEMS) based sensor. The aerosol-generating device may comprise a manually operable switch for a user to initiate a puff.

The aerosol-generating device may comprise a temperature sensor. The temperature sensor may be mounted on the printed circuit board. The temperature sensor may detect the temperature of the electrical heater or the temperature of an aerosol-generating article received within the cavity. The temperature sensor may be a thermistor. The temperature sensor may comprise a circuit configured to measure the resistivity of the electrical heater and derive a temperature of the electrical heater by comparing the measured resistivity to a calibrated curve of resistivity against temperature.

Advantageously, deriving the temperature of the electrical heater may facilitate control of the temperature to which the electrical heater is heated during use. The controller may be configured to adjust the supply of power to the electrical heater in response to a change in the measured resistivity of the electrical heater.

Advantageously, deriving the temperature of the electrical heater may facilitate puff detection. For example, a measured drop in the temperature of the electrical heater may correspond to a user puffing or drawing on the aerosol-generating device.

Preferably, the aerosol-generating device comprises an indicator for indicating when the electrical heater is activated. The indicator may comprise a light, activated when the electrical heater is activated.

The aerosol-generating device may comprise at least one of an external plug or socket and at least one external electrical contact allowing the aerosol-generating device to be connected to another electrical device. For example, the aerosol-generating device may comprise a USB plug or a USB socket to allow connection of the aerosol-generating device to another USB enabled device. The USB plug or socket may allow connection of the aerosol-generating device to a USB charging device to charge a rechargeable power supply within the aerosol-generating device. The USB plug or socket may support the transfer of data to or from, or both to and from, the aerosol-generating device. The aerosol-generating device may be connectable to a computer to transfer data to the aerosol-generating device, such as new heating profiles for new aerosol-generating articles.

In those embodiments in which the aerosol-generating device comprises a USB plug or socket, the aerosol-generating device may further comprise a removable cover that covers the USB plug or socket when not in use. In embodiments in which the USB plug or socket is a USB plug, the USB plug may additionally or alternatively be selectively retractable within the device.

According to a second aspect of the present invention there is provided an aerosol-generating system comprising an aerosol-generating device according to the first aspect of the present invention in accordance with any of the embodiments described herein. The aerosol-generating system also comprises an aerosol-generating article comprising an aerosol-forming substrate.

As used herein, the term "aerosol-generating article" refers to an article comprising an aerosol-forming substrate that, when heated, releases volatile compounds that can form an aerosol.

The aerosol-forming substrate may comprise a plug of tobacco. The tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug. Optionally, the tobacco plug may also contain capsules that, for example, include the additional tobacco or non-tobacco volatile flavour compounds. Such capsules may melt during heating of the tobacco plug.

Alternatively, or in addition, such capsules may be crushed prior to, during, or after heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-generating article may have a total length of between approximately 30 millimetres and approximately 100 millimetres. The aerosol-generating article may have an external diameter of between approximately 5 millimetres and approximately 13 millimetres.

The aerosol-generating article may comprise a mouthpiece positioned downstream of the tobacco plug. The mouthpiece may be located at a downstream end of the aerosol-generating article. The mouthpiece may be a cellulose acetate filter plug. Preferably, the mouthpiece is approximately 7 millimetres in length, but can have a length of between approximately 5 millimetres to approximately 10 millimetres.

The tobacco plug may have a length of approximately 10 millimetres. The tobacco plug may have a length of approximately 12 millimetres.

The diameter of the tobacco plug may be between approximately 5 millimetres and approximately 12 millimetres.

In a preferred embodiment, the aerosol-generating article has a total length of between approximately 40 millimetres and approximately 50 millimetres. Preferably, the aerosol-generating article has a total length of approximately 45 millimetres. Preferably, the aerosol-generating article has an external diameter of approximately 7.2 millimetres.

The invention will now be further described, by way of example only, with reference to the accompanying drawings in which:

FIGS. 7 to 18 illustrate the operation of the mechanical linkage of FIG. 6;

Figure 1:
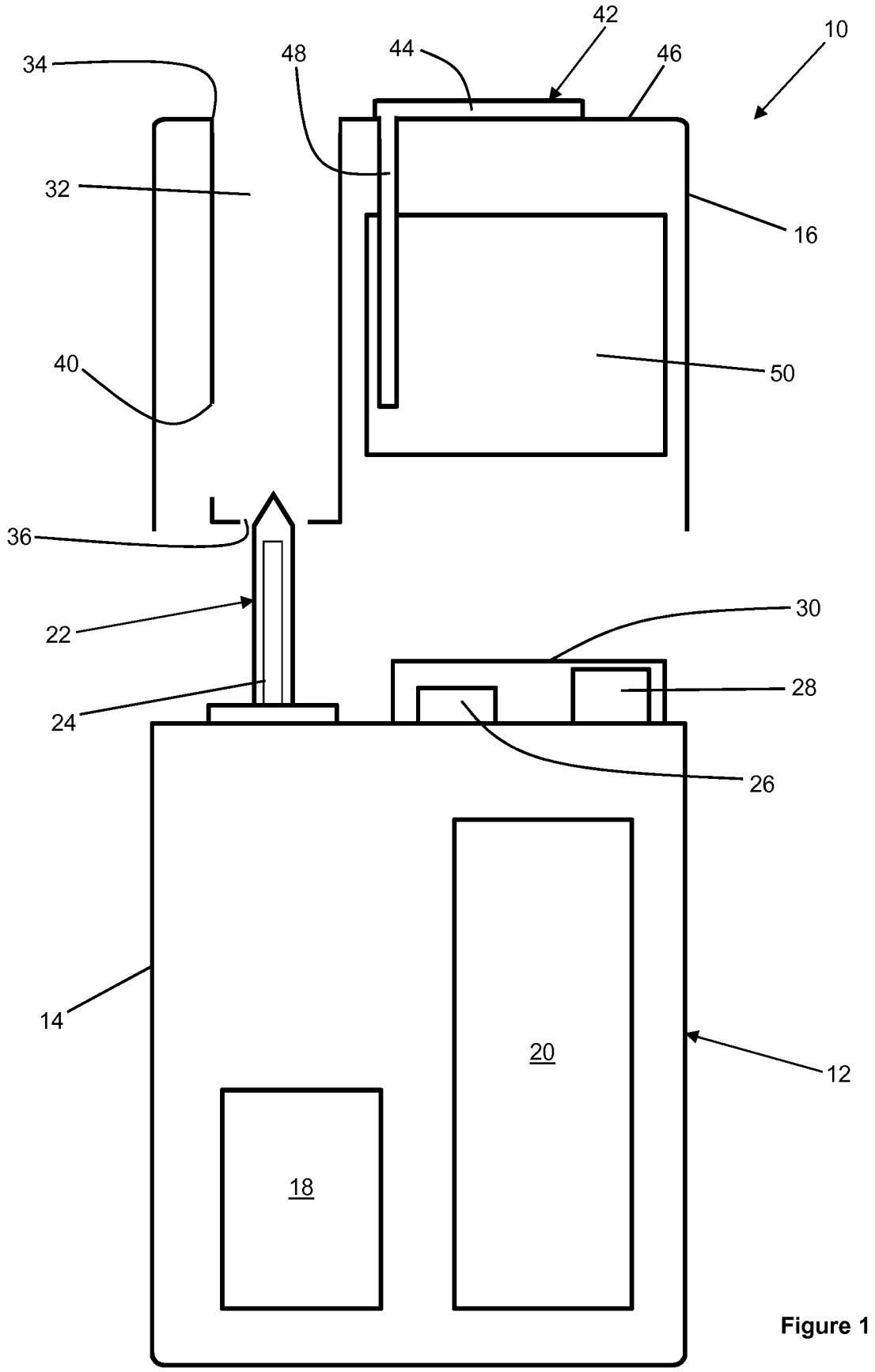
FIG. 1 shows a cross-sectional view of an aerosol-generating device according to an embodiment of the present invention.
Figure 2:
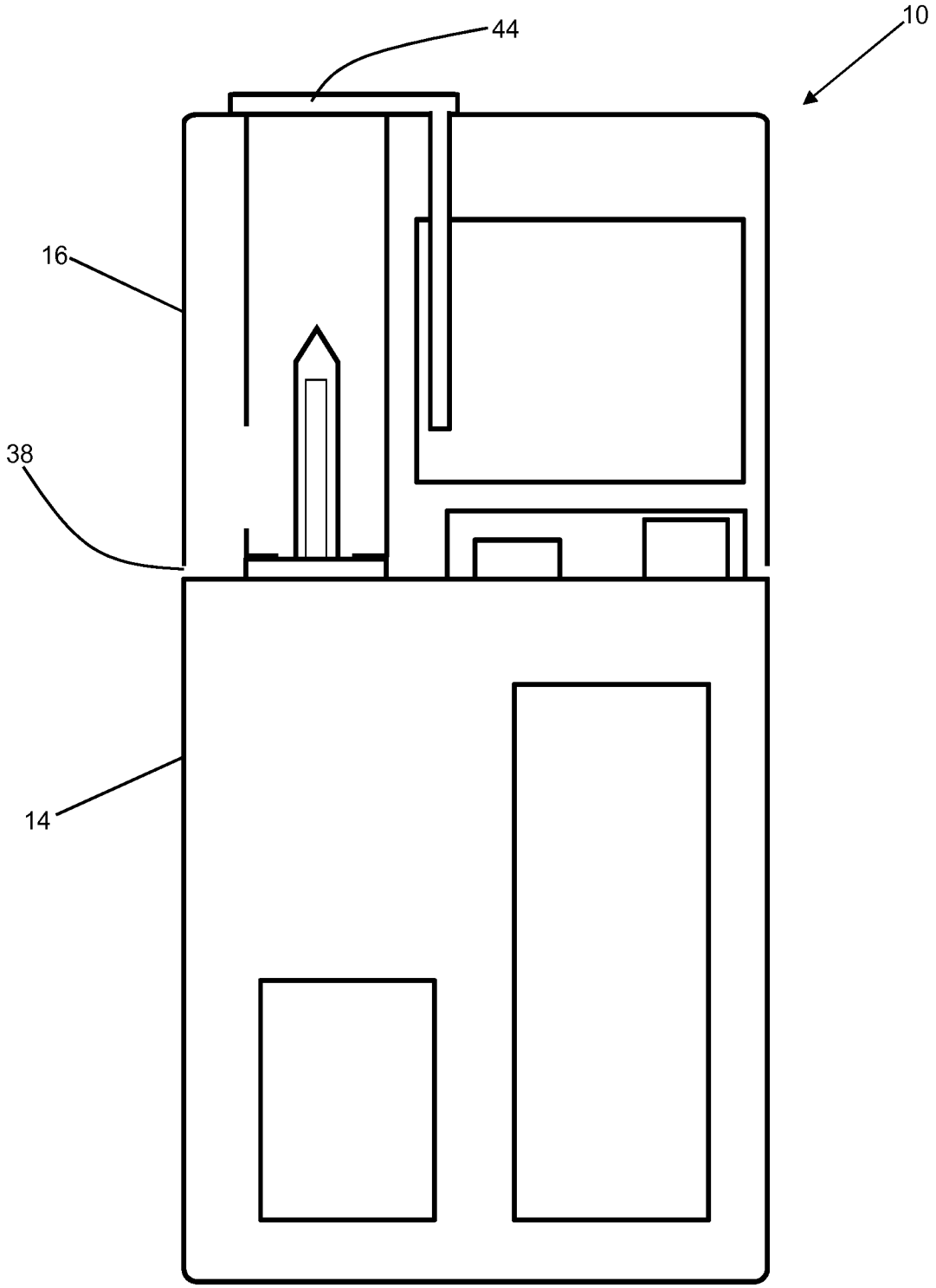
FIG. 2 shows a cross-sectional view of the aerosol-generating device of FIG. 1 with the second housing moved relative to the first housing.

FIGS. 1 and 2 show a cross-sectional view of an aerosol-generating device 10 according to an embodiment of the present invention. The aerosol-generating device 10 comprises a housing 12 comprising a first housing 14 and a second housing 16. The second housing 16 is slidable with respect to the first housing 14 between a compressed position shown in FIG. 2 and an expanded position shown in FIG. 1. The second housing 16 may also be detached from the first housing 14.

The aerosol-generating device 10 also comprises a controller 18 and a power supply 20 positioned within the first housing 14, and a heater 22 extending from an end of the first housing 14. The power supply 20 is an electrical power supply comprising a rechargeable battery. The heater 22 is an electrical heater comprising a resistive heating element 24. During use, the controller 18 supplies power from the power supply 20 to the resistive heating element 24 to resistively heat the heater 22.

Positioned on the first housing 14 next to the heater 22 are a sensor 26 and a first magnet 28. The sensor 26 is an optical sensor comprising a light transmitter and a light receiver. The light transmitter is an infrared light emitting diode and the light receiver is a photodiode. The photodiode is sensitive to infrared light transmitted from the infrared light emitting diode. An optical window 30 overlies the sensor 26, wherein the optical window is transparent to the infrared light transmitted from the infrared light emitting diode.

The second housing 16 defines a cavity 32 for receiving an aerosol-generating article and an aperture 34 positioned at an end of the cavity 32. When the second housing 16 is attached to the first housing 14, the heater 22 extends into the cavity 32 via a heater opening 36 defined by the second housing 16. An air inlet 38 is formed by a gap between the first housing 14 and the second housing 16. The air inlet 38 is in fluid communication with the cavity 32 via an airflow opening 40 defined by the second housing 16.

When an aerosol-generating article is received within the cavity 32, the aerosol-generating article and the aerosol-generating device 10 together form an aerosol-generating system. During use, the heater 22 heats the aerosol-generating article received within the cavity 32 to generate an aerosol. When a user draws on the aerosol-generating article, air is drawn into the aerosol-generating device 10 via the air inlet 38 and into the cavity 32 through the airflow opening 40. The air then flows through the aerosol-generating article to deliver the generated aerosol to the user.

Figure 3:
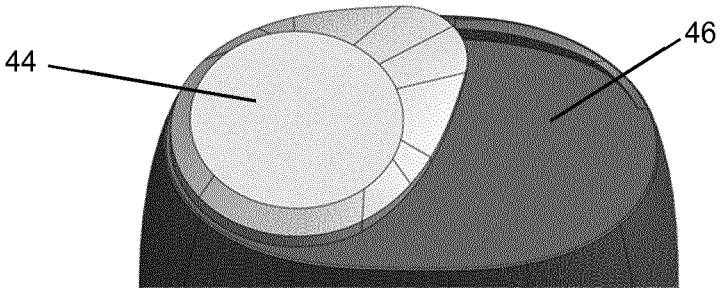
FIGS. 3 to 5 illustrate the rotational movement of the cover element of the aerosol-generating device of FIGS. 1 and 2.
Figure 4:
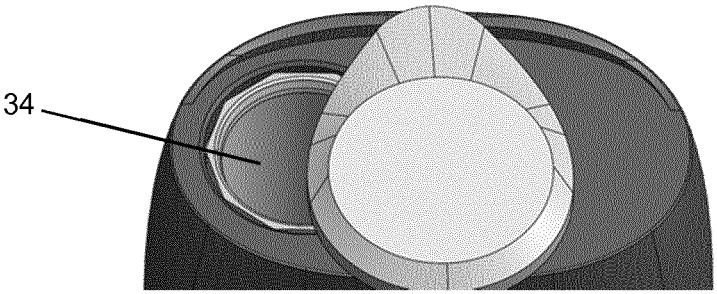
Figure 5:
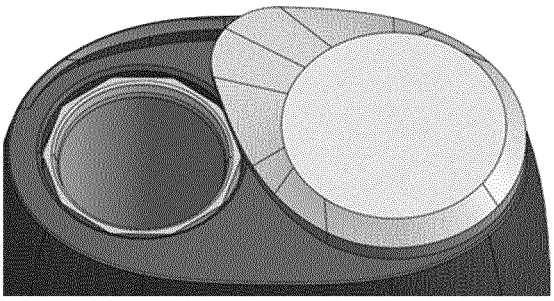

The aerosol-generating device 10 also comprises a cover element 42 comprising a cover portion 44 overlying an end wall 46 of the second housing 16 and a shaft portion 48 extending through the end wall 46. The cover element 42 is rotatable between a closed position in which the cover portion 44 covers the aperture 34 and an open position in which the cover portion 44 does not cover the aperture 34. The closed position is shown in FIG. 2 and the open position is shown in FIG. 1. FIGS. 3 to 5 illustrate the rotation of the cover element 42 from the closed position (FIG. 3) to the open position (FIG. 5).

Figure 6:
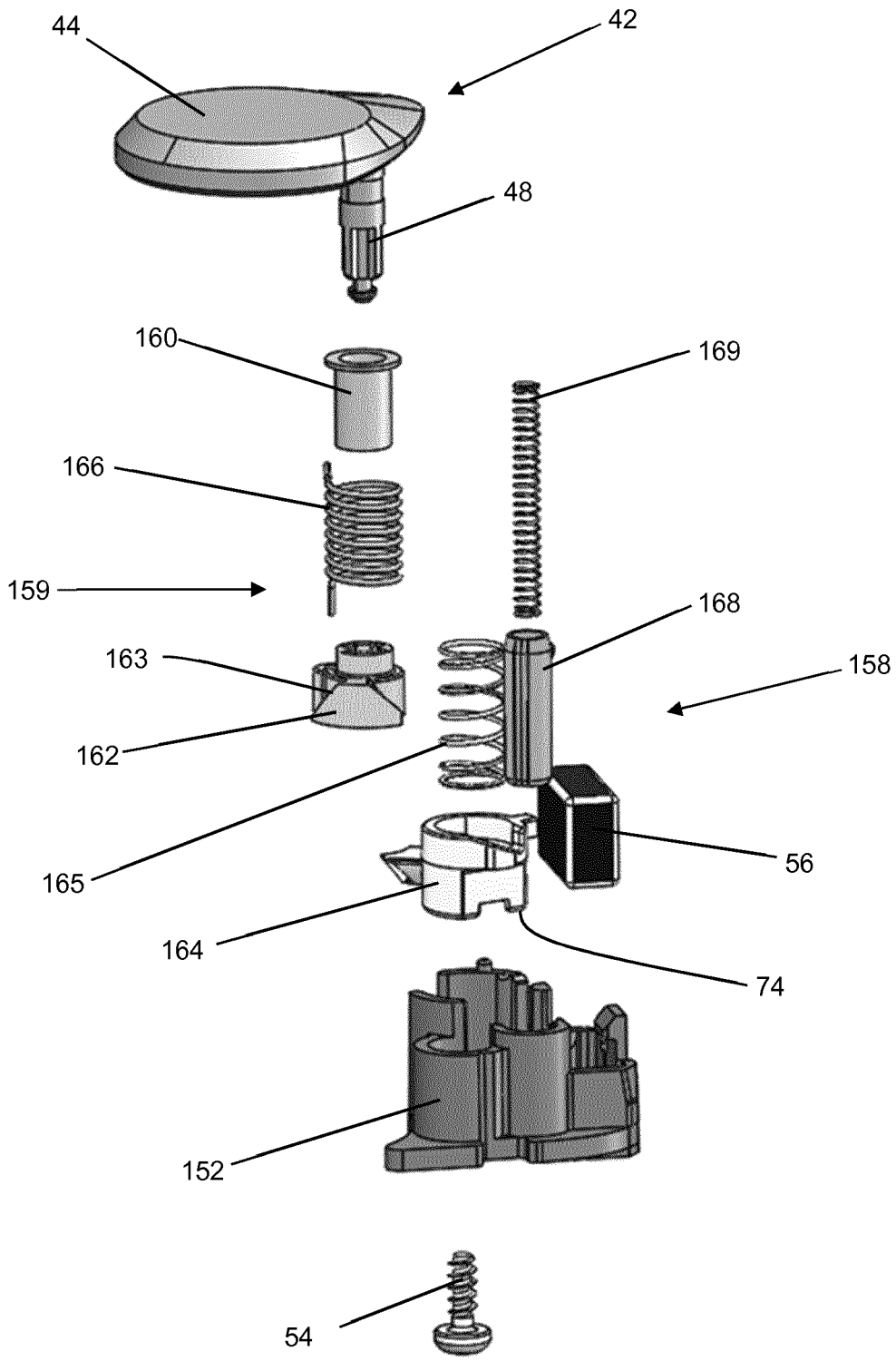
FIG. 6 shows an exploded perspective view of the mechanical linkage of the aerosol-generating device of FIGS. 1 and 2.
Figure 9:
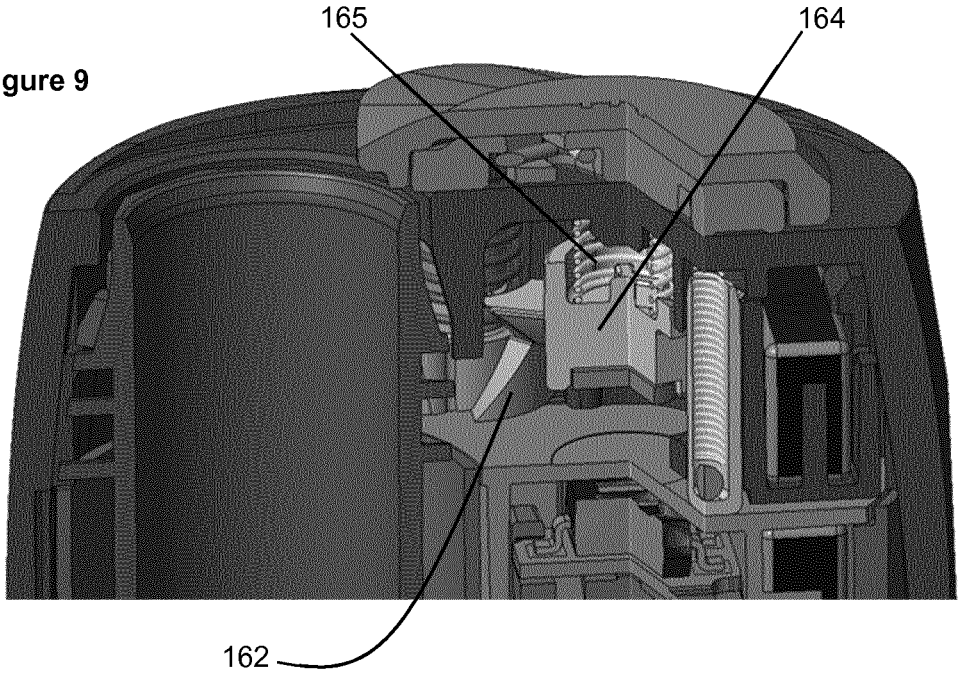

Positioned within the second housing 16 is a mechanical linkage 50 arranged to interact with the shaft portion 48 of the cover element 42. An exploded view of the mechanical linkage 50 is shown in FIG. 6.

The mechanical linkage 50 comprises a chassis 152 attached to the second housing 16 by a screw 54. Mounted onto the chassis 152 is second magnet 56 arranged to interact with the first magnet 28 on the first housing 14. In particular, the first and second magnets 28, 56 are magnetically attracted to each other to facilitate attachment of the second housing 16 to the first housing 14.

Also mounted on the chassis 152 are a latching mechanism 158 and a closing mechanism 159 comprising a bushing 160, a cam 162, a cam follower 164, a cam follower biasing spring 165, a torsion spring 166, a release pin 168 and a release pin biasing spring 169.

The cam 162 is connected to an end of the shaft portion 48 of the cover element 42 by an interference fit. Therefore, when the cover element 42 is rotated between the closed and open positions, the cam 162 is also rotated. The bushing 160 and the torsion spring 166 are positioned coaxially about the shaft portion 48 of the cover element 42.

The cam follower 164 is slidably received within the chassis 152 and engages a first cam surface 163 formed on the cam 162. Therefore, when the cam 162 rotates during rotation of the cover element 42, the cam follower 164 moves up and down within the chassis 152. An indicator element 74 comprising an optically reflective aluminium layer is positioned on a bottom surface of the cam follower 164. When the cam follower 164 moves up and down within the chassis 152, the sensor 26 senses a change in distance between the sensor 26 and the indicator element 74. Based on the sensed distance between the sensor 26 and the indicator element 74, the sensor 26 provides a signal to the controller 18 indicative of whether the cover element 42 is in the closed position or the open position.

If the signal from the sensor 26 is indicative of the cover element 42 being in the closed position, it is assumed that an aerosol-generating article is not received within the cavity 32 and the controller 18 will not supply power from the power supply 20 to the heater 22 for heating an aerosol-generating article.

If the signal from the sensor 26 is indicative of the cover element 42 being in the open position, an aerosol-generating article may be received within the cavity 32 and the controller 18 may supply power from the power supply 20 to the heater 22 for heating an aerosol-generating article.

If the sensor 26 cannot detect the indicator element 74 it is assumed that the second housing 16 has been detached from the first housing 14. In this case, the sensor 26 provides a signal to the controller 18 indicative of the second housing 16 being detached from the first housing 14 and the controller 18 will prevent the supply of power to the heater 22.

The operation of the latching mechanism 158 and the closing mechanism 159 will now be described with reference to FIGS. 7 to 18.

FIG. 7 shows the cover element 42 in the closed position. When the cover element 42 is in the closed position, the cam follower 164 is biased into a lowered position by the cam follower biasing spring 165 and the release pin 168 is maintained in a raised position by the first housing 14, as shown in FIG. 8.

Figure 10:
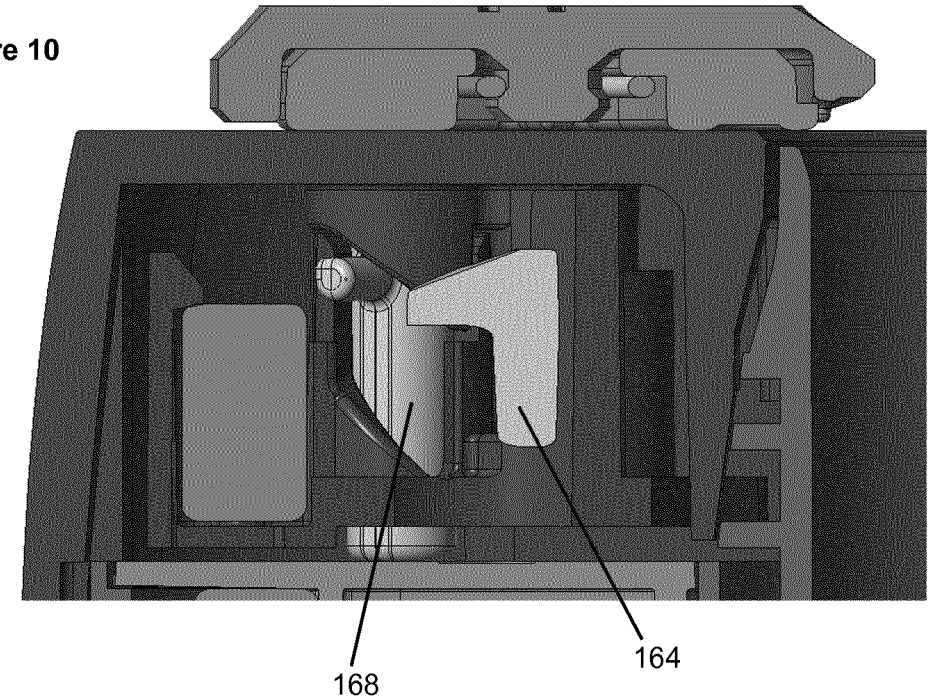

When the cover element 42 is rotated towards the open position, the rotation of the cam 162 raises the cam follower 164 into a raised position against the force of the cam follower biasing spring 165 and loads the torsion spring 166. As shown in FIG. 10, the release pin 168 remains in its raised position.

Figure 11:
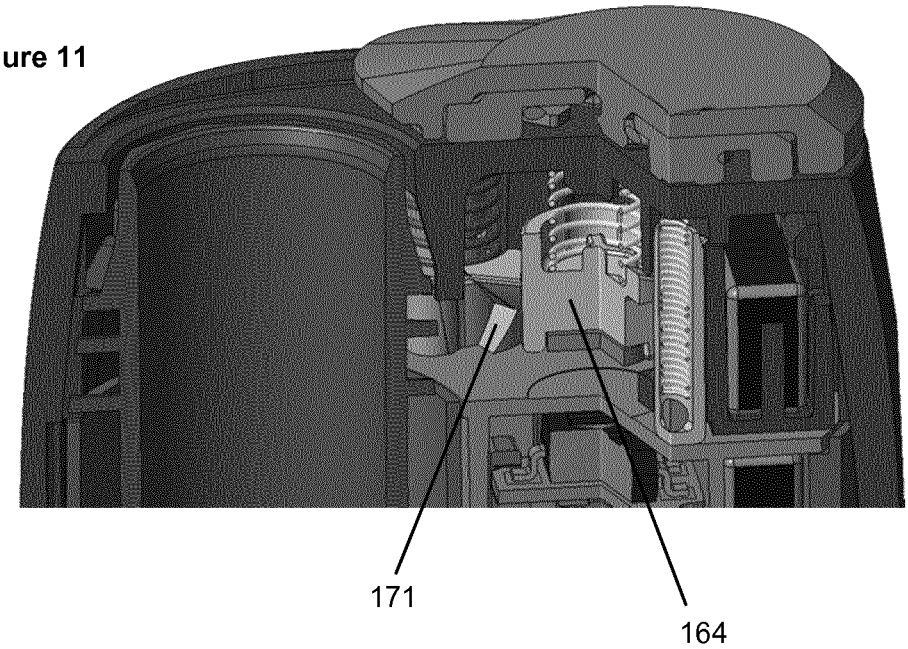
Figure 12:
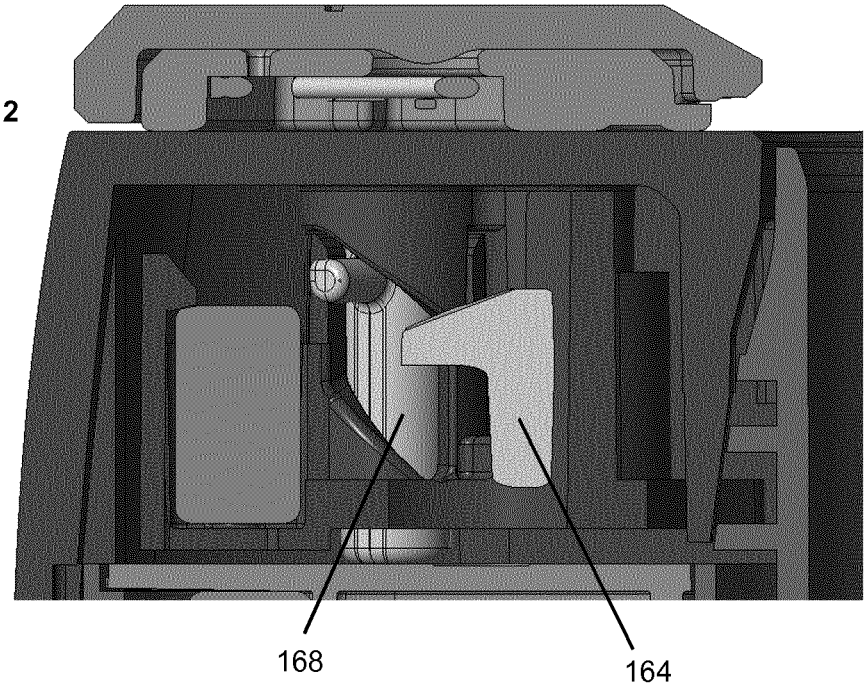

When the cover element 42 reaches the open position, the cam follower 164 is received within a detent 171 defined by the first cam surface 163 of the cam 162, as shown in FIG. 11. When the cam follower 164 is received within the detent 171, the torsion spring 166 is unable to rotate the cam 162 and the cover element 42 back towards the closed position. The release pin 168 remains in its raised position, as shown in FIG. 12.

Figure 13:
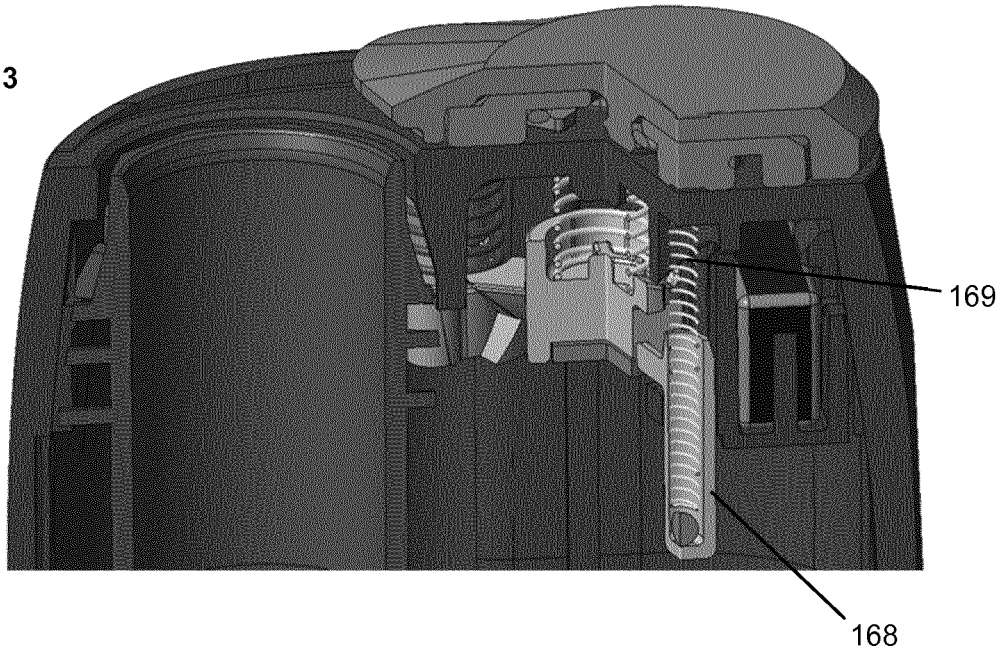
Figure 14:
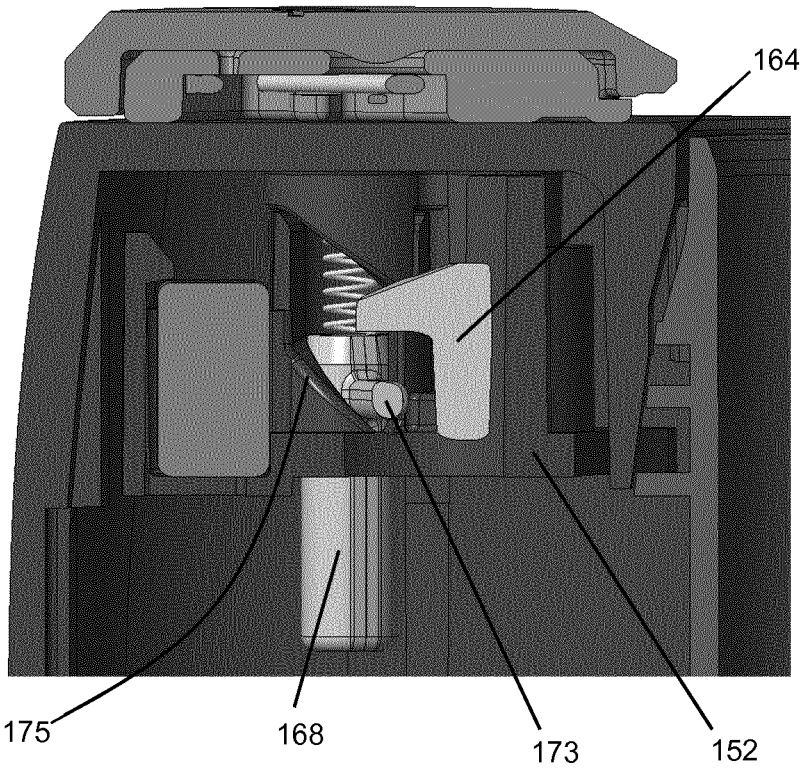

When the second housing 16 is moved away from the first housing 14, the release pin biasing spring 169 pushed the release pin 168 into a lowered position, as shown in FIGS. 13 and 14. During the motion of the release pin 168 into its lowered position, a projection 173 on the release pin 168 engages a second cam surface 175 defined by the chassis 152, which rotates the release pin 168 to position the projection 173 underneath the cam follower 164.

Figure 15:
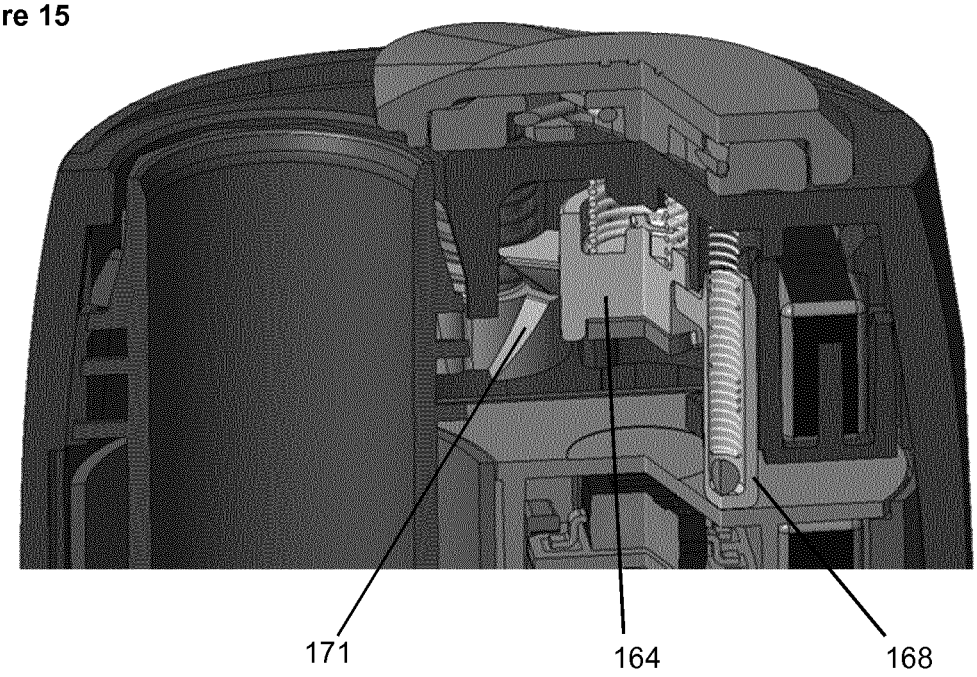
Figure 16:
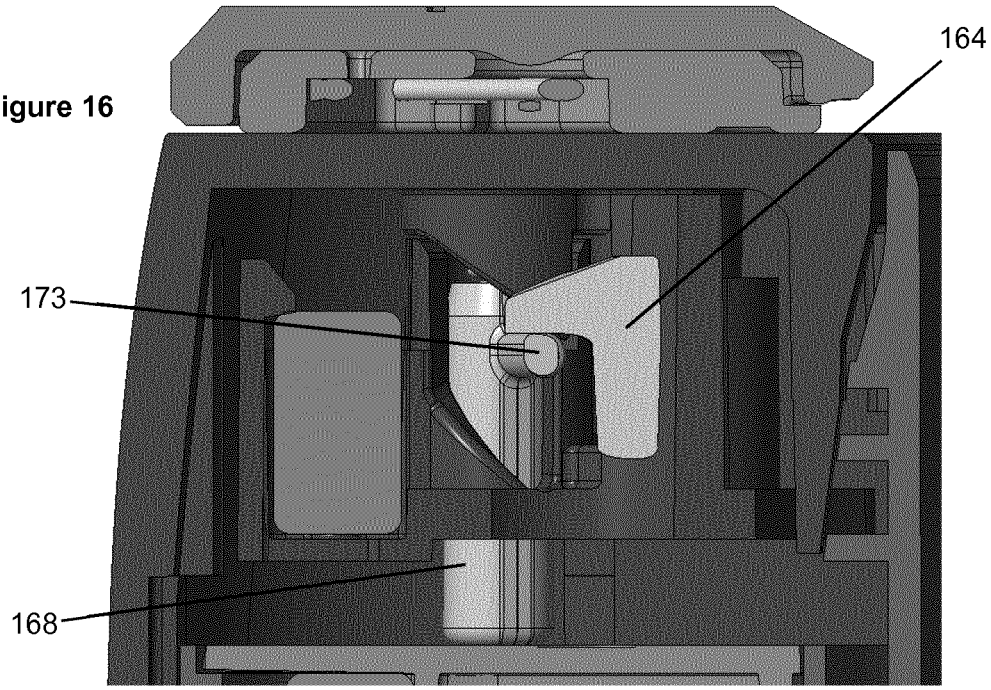

When the second housing 16 is moved towards the first housing 14, the first housing 14 pushes the release pin 168 upwards against the force of the release pin biasing spring 169. As the release pin 168 moves upwards, the projection 173 on the release pin 168 engages the cam follower 164 and pushes the cam follower 164 towards its raised position, as shown in FIGS. 15 and 16. As the cam follower 164 is pushed towards its raised position, the cam follower 164 is disengaged from the detent 171 defined by the first cam surface 163 of the cam 162.

Figure 17:
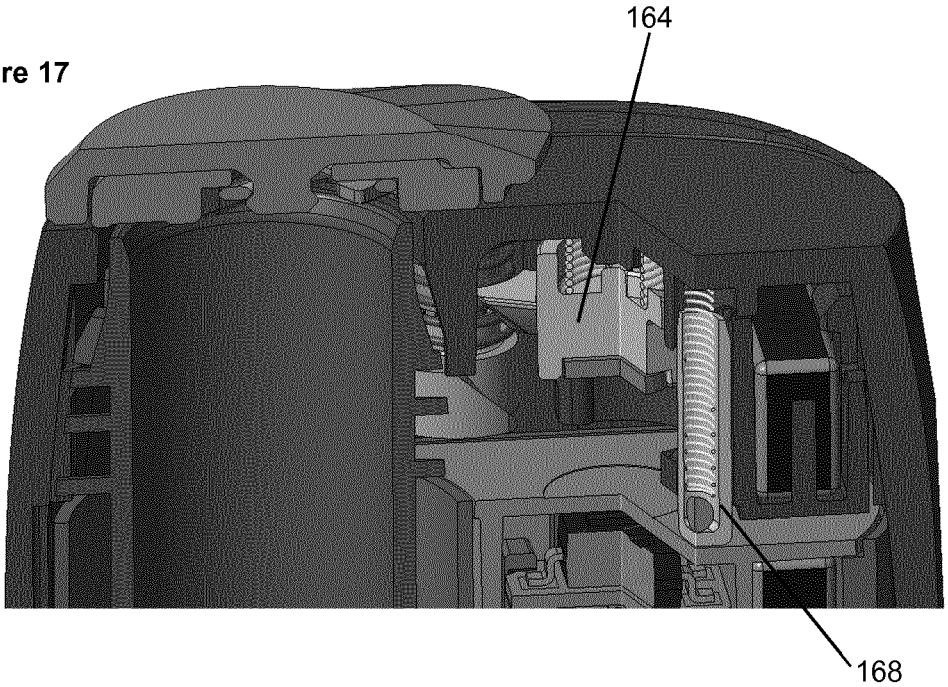
Figure 18:
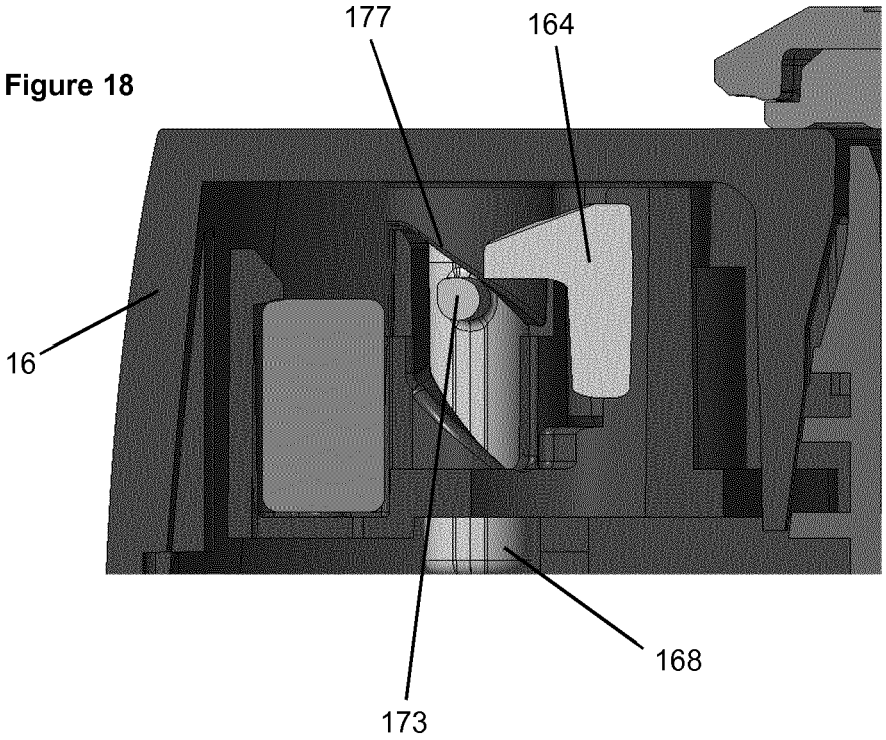

When the cam follower 164 is disengaged from the detent 171 defined by the first cam surface 163 of the cam 162, the torsion spring 166 rotates the cam 162 and returns the cover element 42 to the closed position, as shown in FIG. 17. At the same time, the first housing 14 continues to push the release pin 168 upwards and the projection 173 on the release pin 168 engages a third cam surface 177 defined by the second housing 16. The third cam surface 177 rotates the projection 173 away from the cam follower 164 so that the release pin 168 disengages the cam follower 164, as shown in FIG. 18. At this point, the latching mechanism 158 and the closing mechanism 159 have returned to the initial configurations shown in FIGS. 7 and 8.

Figure 19:
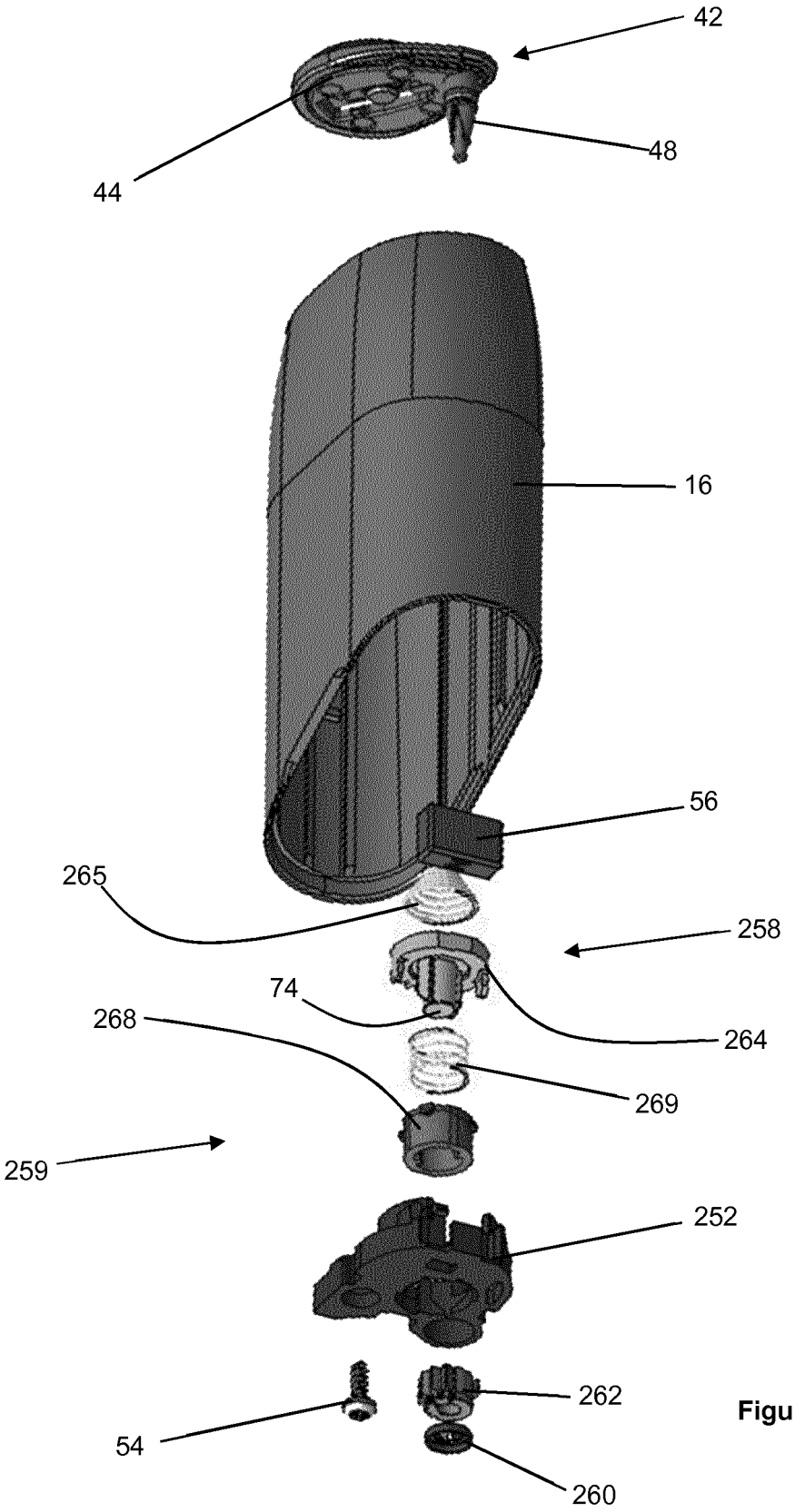
FIG. 19 shows an exploded perspective view of an alternative arrangement of the mechanical linkage of the aerosol-generating device of FIGS. 1 and 2.

FIG. 19 shows an exploded view of an alternative arrangement of the mechanical linkage 50.

The alternative mechanical linkage comprises a chassis 252 attached to the second housing 16 by a screw 54. Mounted onto the chassis 252 is second magnet 56 arranged to interact with the first magnet 28 on the first housing 14. In particular, the first and second magnets 28, 56 are magnetically attracted to each other to facilitate attachment of the second housing 16 to the first housing 14.

Also mounted on the chassis 252 are a latching mechanism 258 and a closing mechanism 259 comprising a washer 260, a first gear 262, a geared cam follower 264, a cam follower biasing spring 265, a release element 268 and a release element biasing spring 269.

The washer 260 is formed from a low friction material to facilitate rotation of the first gear 262 on the chassis 252. The first gear 262 is connected to an end of the shaft portion 48 of the cover element 42 by an interference fit. Therefore, when the cover element 42 is rotated between the closed and open positions, the first gear 262 is also rotated.

The geared cam follower 264 is slidably received within the chassis 252 and engages the first gear 262 and a first cam surface 263 formed by the chassis 252. Therefore, when the first gear 262 rotates during rotation of the cover element 42, the geared cam follower 264 moves up and down within the chassis 252. An indicator element 74 comprising an optically reflective aluminium layer is positioned on a bottom surface of the geared cam follower 264. When the geared cam follower 264 moves up and down within the chassis 252, the sensor 26 senses a change in distance between the sensor 26 and the indicator element 74. Based on the sensed distance between the sensor 26 and the indicator element 74, the sensor 26 provides a signal to the controller 18 indicative of whether the cover element 42 is in the closed position or the open position.

If the signal from the sensor 26 is indicative of the cover element 42 being in the closed position, it is assumed that an aerosol-generating article is not received within the cavity 32 and the controller 18 will not supply power from the power supply 20 to the heater 22 for heating an aerosol-generating article.

If the signal from the sensor 26 is indicative of the cover element 42 being in the open position, an aerosol-generating article may be received within the cavity 32 and the controller 18 may supply power from the power supply 20 to the heater 22 for heating an aerosol-generating article.

If the sensor 26 cannot detect the indicator element 74 it is assumed that the second housing 16 has been detached from the first housing 14. In this case, the sensor 26 provides a signal to the controller 18 indicative of the second housing 16 being detached from the first housing 14 and the controller 18 will prevent the supply of power to the heater 22.

The operation of the latching mechanism 258 and the closing mechanism 259 will now be described with reference to FIGS. 20 to 29.

Figure 20:
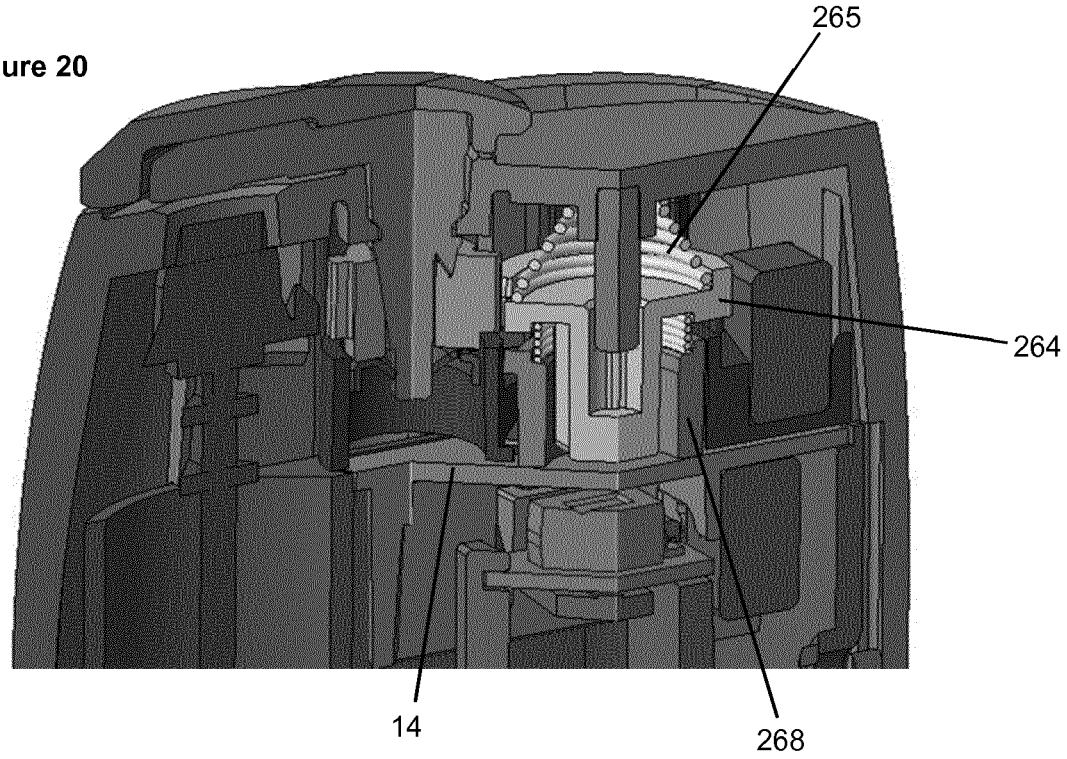
FIGS. 20 to 29 illustrate the operation of the mechanical linkage of FIG. 19.
Figure 21:
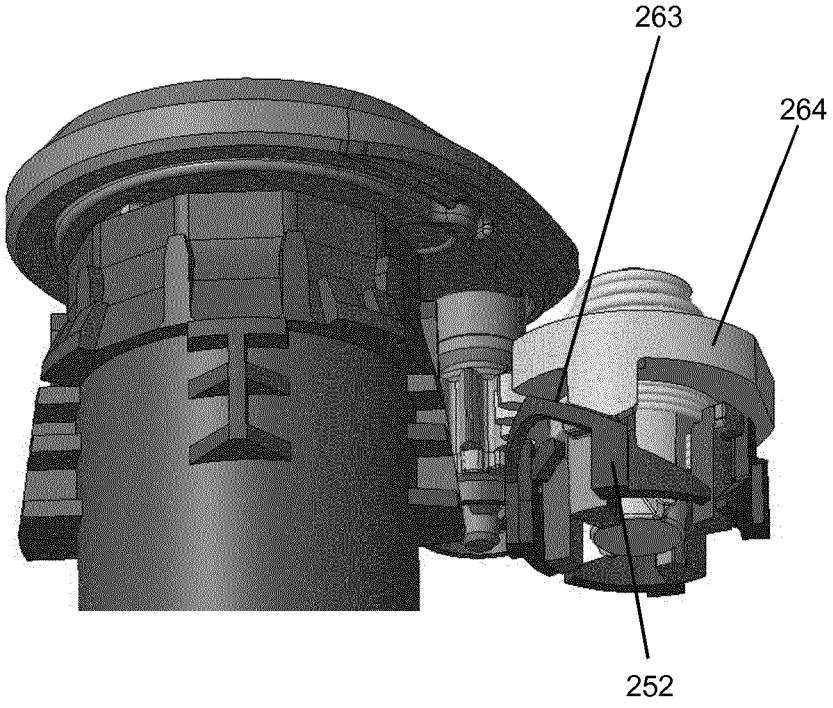
Figure 28:
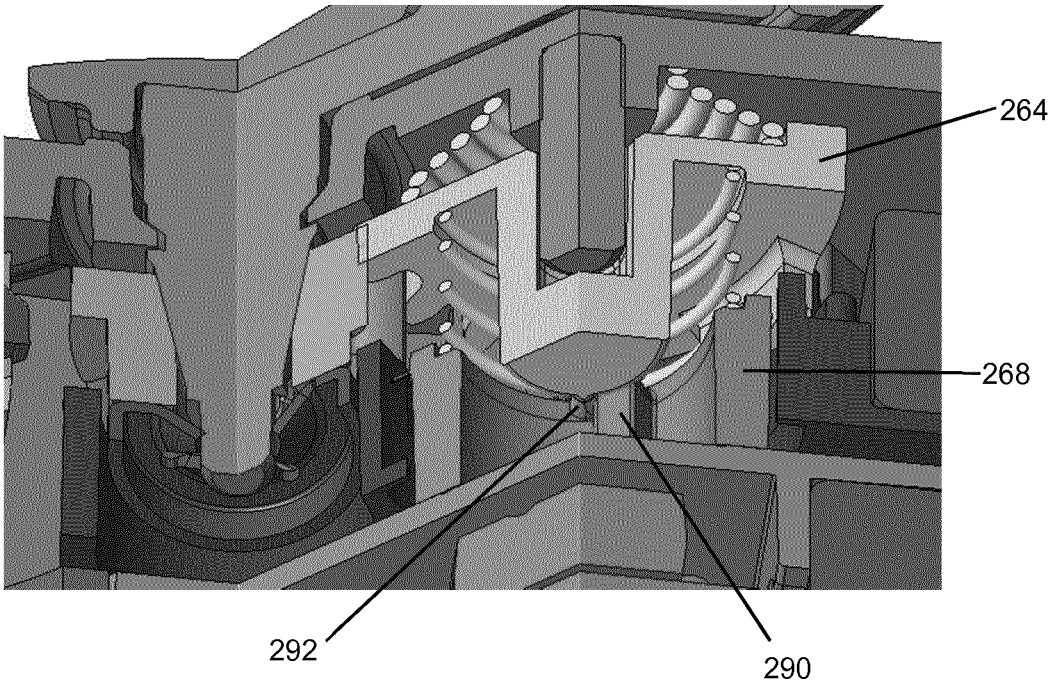
Figure 29:
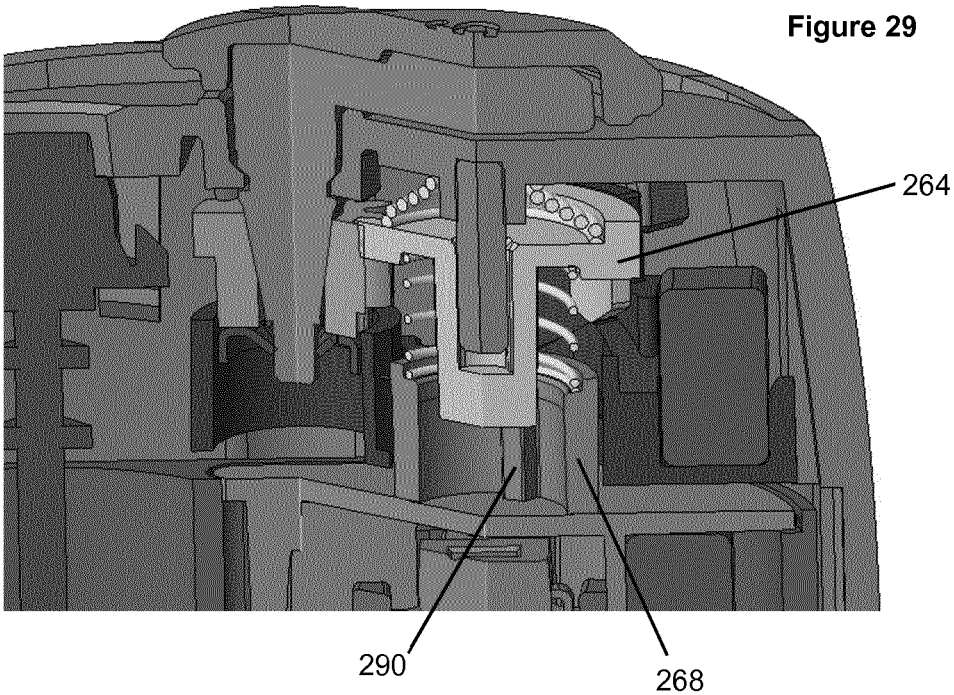

FIG. 20 shows the cover element 42 in the closed position. When the cover element 42 is in the closed position, the geared cam follower 264 is biased into a lowered position by the cam follower biasing spring 265 and the release element 268 is maintained in a raised position by the first housing 14, as shown in FIG. 21. In the raised position, an internal rib 290 on the release element 268 is engaged with an external rib 292 on the geared cam follower 264, as shown in FIGS. 28 and 29.

Figure 22:
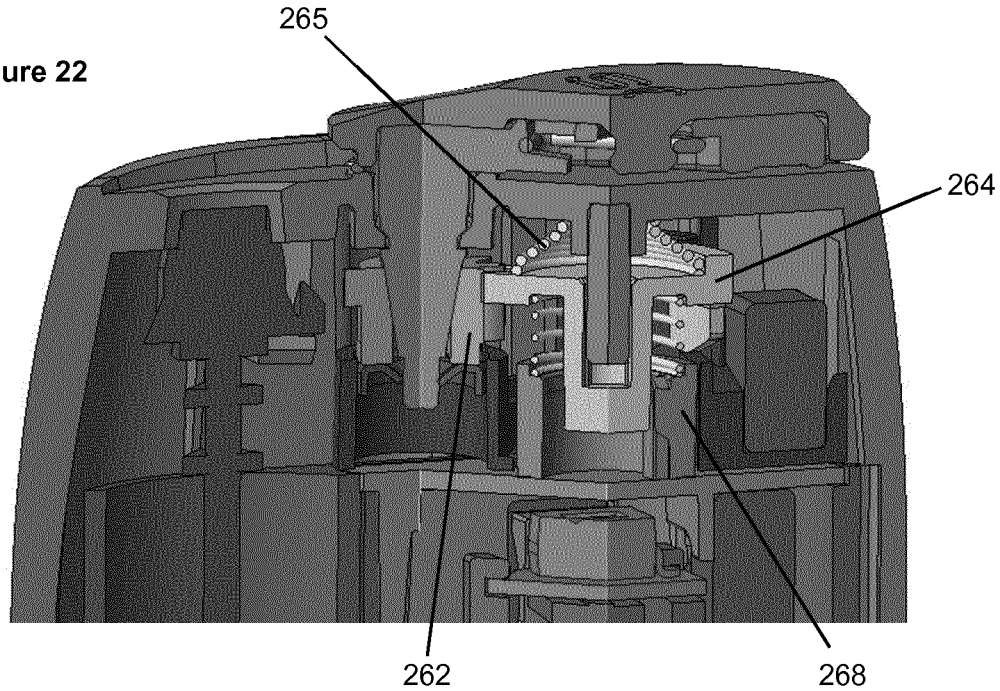
Figure 23:
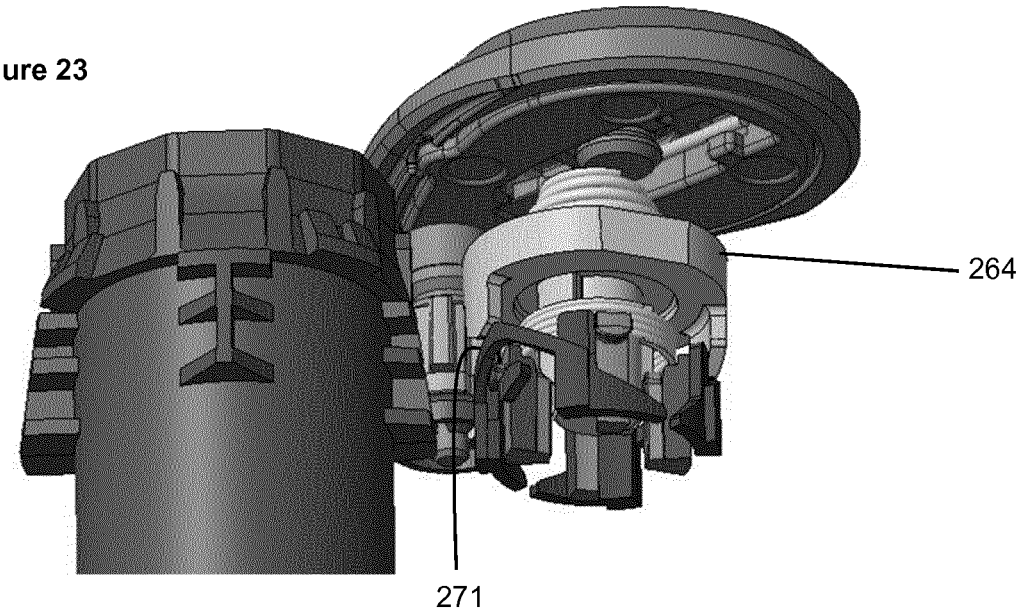

When the cover element 42 is rotated towards the open position, the rotation of the first gear 262 rotates the geared cam follower 264, which rotates the release element 268. During rotation of the geared cam follower 264, the first cam surface 263 raises the geared cam follower 264 into a raised position against the force of the cam follower biasing spring 265, as shown in FIG. 22. When the cover element 42 reaches the open position, the geared cam follower 264 is received within a detent 271 defined by the first cam surface 263, as shown in FIG. 23. When the geared cam follower 264 is received within the detent 271, the cover element 42 cannot be rotated back towards the closed position.

Figure 24:
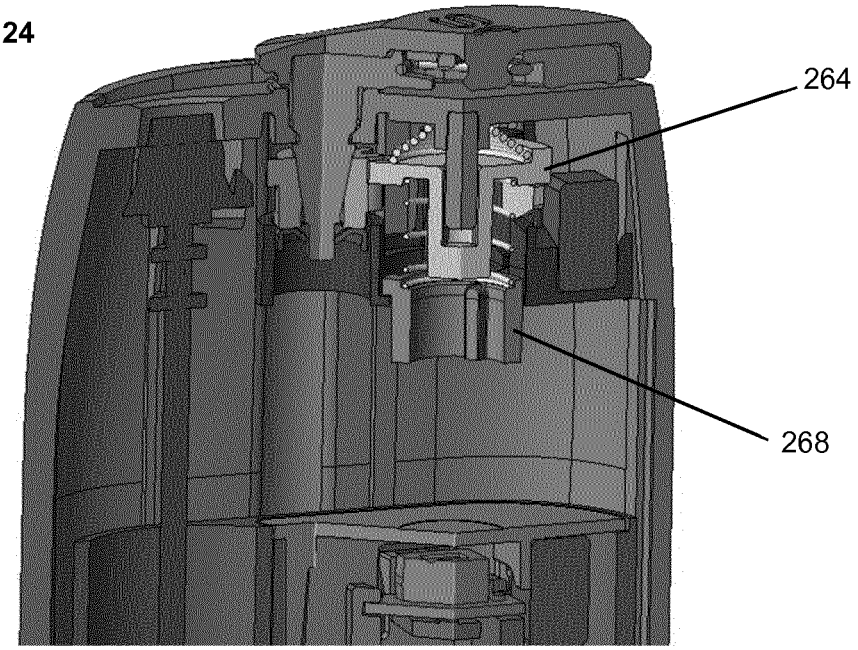
Figure 25:
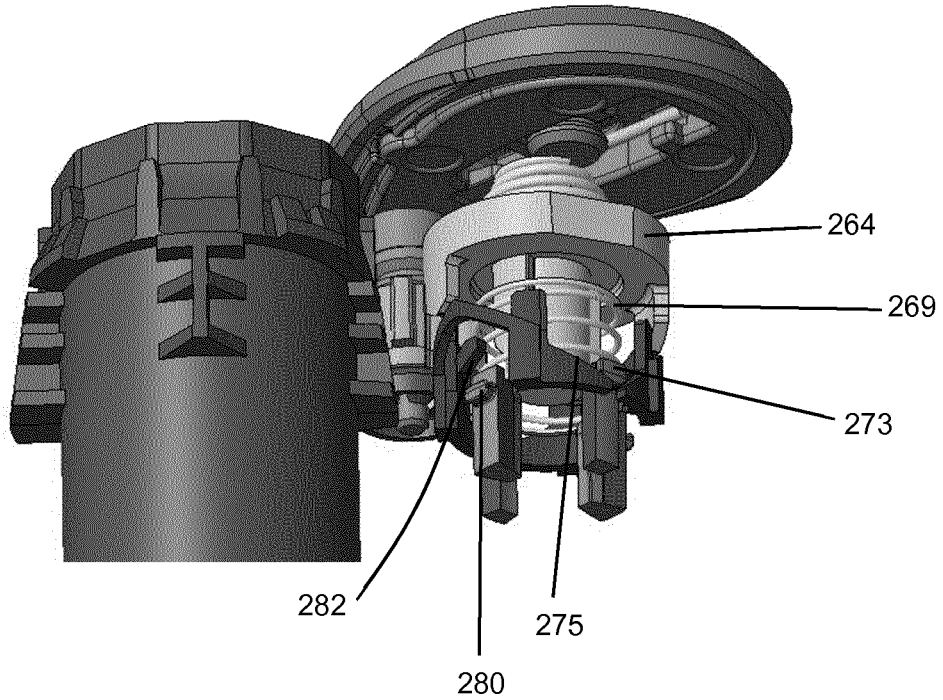

When the second housing 16 is moved away from the first housing 14, the release element biasing spring 269 pushed the release element 268 into a lowered position, which disengages the internal rib 290 on the release element 268 from the external rib 292 on the geared cam follower 264. During the motion of the release element 268 into its lowered position, a first projection 273 on the release element 268 engages a second cam surface 275 defined by the chassis 252, which rotates the release element 268 to a position in which a second projection 280 is positioned underneath a third cam surface 282 defined by the chassis 252, as shown in FIGS. 24 and 25.

Figure 26:
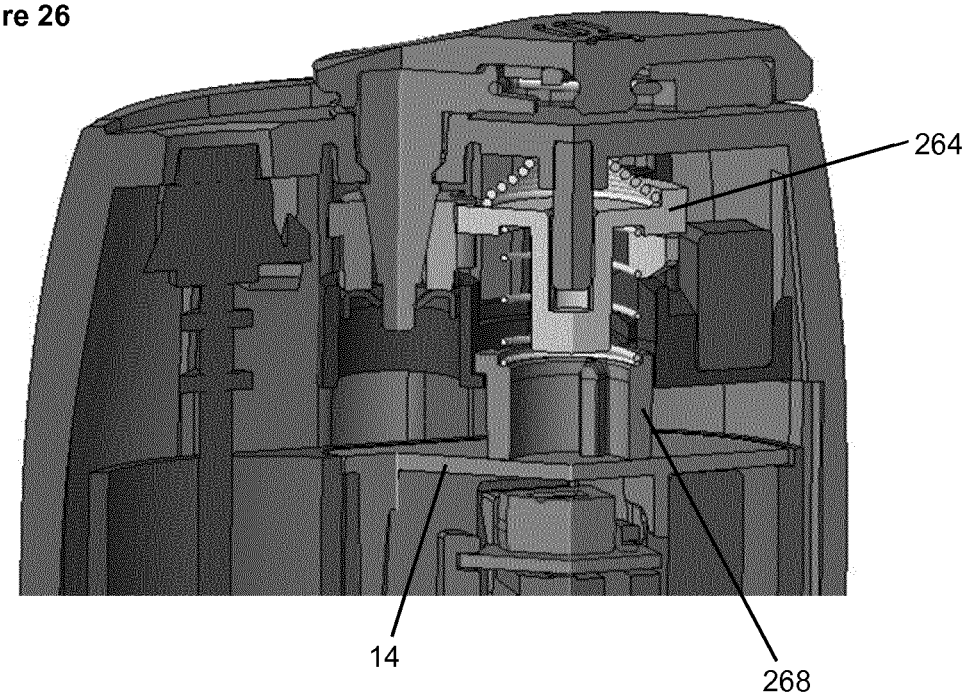
Figure 27:
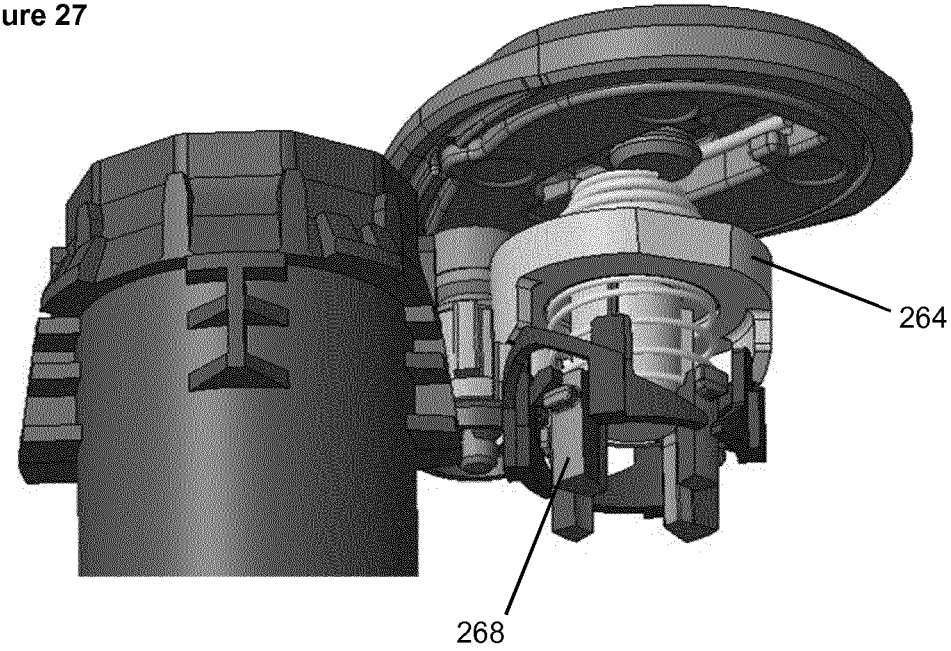

When the second housing 16 is moved towards the first housing 14, the first housing 14 pushes the release element 268 upwards against the force of the release element biasing spring 269, as shown in FIG. 26. As the release element 268 moves upwards, the internal rib 290 on the release element 268 engages the external rib 292 on the geared cam follower 264 and disengages the geared cam follower 264 from the detent 271. At the same time, the second projection 280 on the release element 268 engages the third cam surface 282 as shown in FIG. 27, which rotates the release element 268, the geared cam follower 264 and the cover element back to the initial configuration show in FIGS. 20 and 21.

Figure 30:
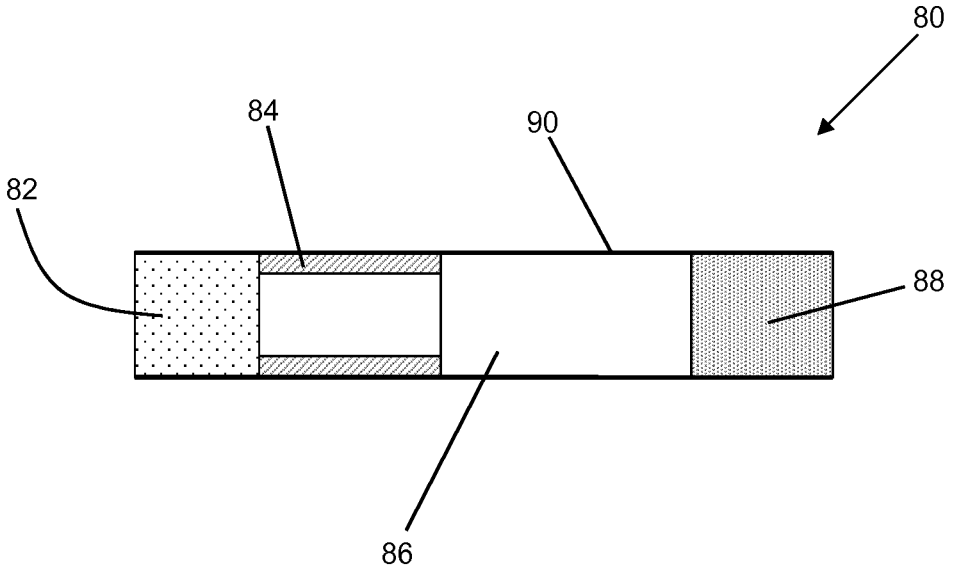
FIG. 30 shows a cross-sectional view of an aerosol-generating article for use with the aerosol-generating device of FIGS. 1 and 2.

FIG. 30 shows a cross-sectional view of an aerosol-generating article 80 for use with the aerosol-generating device 10. The aerosol-generating article 80 comprises an aerosol-forming substrate 82 in the form of a tobacco plug, a hollow acetate tube 84, a polymeric filter 86, a mouthpiece 88 and an outer wrapper 90. When the aerosol-generating article 80 is received within the cavity 32 of the aerosol-generating device 10, the heater 22 is received within the tobacco plug. During use, the heater 22 heats the tobacco plug to generate an aerosol.

The invention claimed is:

1. An aerosol-generating device, comprising:

a first housing;

a second housing configured to move relative to the first housing;

a cavity configured to receive an aerosol-generating article;

an aperture at least partially defined by the second housing, wherein the aperture is disposed at an end of the cavity and configured for insertion of the aerosol-generating article into the cavity through the aperture;

a cover element configured to move, with respect to the second housing, between a closed position in which the cover element at least partially covers the aperture and an open position in which the aperture is at least partially uncovered;

a latching mechanism configured to retain the cover element in the open position and to release the cover element when the second housing is moved relative to the first housing; and a closing mechanism configured to move the cover element away from the open position and into the closed position when the latching mechanism releases the cover element, wherein the second housing is arranged for sliding movement relative to the first housing, and wherein the latching mechanism is arranged to release the cover element when the second housing is moved away from the first housing or towards the first housing.

2. The aerosol-generating device according to claim 1, wherein the cover element is further configured so that the cover element entirely covers the aperture when the cover element is in the closed position.

3. The aerosol-generating device according to claim 1, wherein the aperture is entirely uncovered when the cover element is in the open position.

4. The aerosol-generating device according to claim 3, wherein the cover element is rotatable with respect to the second housing between the closed position and the open position.

5. The aerosol-generating device according to claim 3,
wherein the cover element comprises a cover portion and a shaft portion extending from the cover portion,
wherein the cover portion is configured to at least partially cover the aperture when the cover element is in the closed position, and
wherein the shaft portion is received within the second housing.

6. The aerosol-generating device according to claim 5, wherein the latching mechanism comprises:
a cam connected to the shaft portion of the cover element, the cam defining a cam surface; and
a cam follower disposed within the second housing and engaged with the cam surface,
wherein the cam surface defines a detent in which the cam follower is received when the cover element is in the open position.

7. The aerosol-generating device according to claim 6, wherein the latching mechanism further comprises a cam follower biasing element configured to bias the cam follower against the cam surface.

8. The aerosol-generating device according to claim 6,
wherein the latching mechanism further comprises a release pin disposed within the second housing and configured to move with respect to the second housing, and
wherein the first housing is configured to engage the release pin during movement of the second housing relative to the first housing to bias the release pin against the cam follower to disengage the cam follower from the detent.

9. The aerosol-generating device according to claim 8,
wherein the release pin is moveable between a first position when the second housing is moved away from the first housing and a second position when the second housing is moved towards to the first housing, and
wherein the latching mechanism further comprises a release pin biasing element configured to bias the release pin towards the first position.

10. The aerosol-generating device according to claim 1, wherein the closing mechanism comprises a cover biasing element configured to bias the cover element towards the closed position.

11. The aerosol-generating device according to claim 5, wherein the latching mechanism comprises:
a first gear connected to the shaft portion of the cover element;
a geared cam follower disposed within the second housing, wherein a surface of the geared cam follower defines a second gear engaged with the first gear; and
a first cam surface fixed with respect to the second housing,
wherein the geared cam follower is engaged with the first cam surface, and
wherein the first cam surface defines a detent in which the geared cam follower is received when the cover element is in the open position.

12. The aerosol-generating device according to claim 11, wherein the latching mechanism further comprises a cam follower biasing element configured to bias the geared cam follower against the first cam surface.

13. The aerosol-generating device according to claim 12,
wherein the latching mechanism further comprises a release element disposed within the second housing and configured to move with respect to the second housing, and
wherein the first housing is configured to engage the release element when the second housing is moved relative to the first housing to bias the release element against the geared cam follower to disengage the geared cam follower from the detent.

14. The aerosol-generating device according to claim 13,
wherein the release element is moveable between a first position when the second housing is moved away from the first housing and a second position when the second housing is moved towards the first housing, and
wherein the latching mechanism further comprises a release element biasing element configured to bias the release element towards the first position.

15. The aerosol-generating device according to claim 14,
wherein the closing mechanism comprises a second cam surface fixed with respect to the second housing,
wherein the release element is configured to engage the second cam surface to rotate the release element from the second position to a third position, and
wherein the release element is configured to engage the geared cam follower so that, when the release element rotates from the second position to the third position, the release element rotates the geared cam follower to move the cover element from the open position to the closed position.

16. An aerosol-generating system comprising an aerosol-generating device according to claim 1 and an aerosol-generating article, wherein the aerosol-generating article comprises an aerosol-forming substrate.

17. The aerosol-generating device according to claim 1,
wherein the cover element comprises a single cover portion and a single shaft portion extending from the single cover portion,
wherein the single shaft portion is received within the second housing,
wherein the single cover portion covers at least 95 percent of the aperture when the cover element is in the closed position, and
wherein the single cover portion covers less than 5 percent of the aperture when the cover element is in the open position.

* * * * *